US010832855B2

(12) United States Patent
Okura et al.

(10) Patent No.: US 10,832,855 B2
(45) Date of Patent: Nov. 10, 2020

(54) ELECTRONIC COMPONENT AND MANUFACTURING METHOD THEREOF

(71) Applicant: Murata Manufacturing Co., Ltd., Kyoto (JP)

(72) Inventors: Ryo Okura, Nagaokakyo (JP); Hayami Kudo, Nagaokakyo (JP); Akinori Hamada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 277 days.

(21) Appl. No.: 15/950,601

(22) Filed: Apr. 11, 2018

(65) Prior Publication Data

US 2018/0315541 A1 Nov. 1, 2018

(30) Foreign Application Priority Data

Apr. 27, 2017 (JP) ..... 2017-088756

(51) Int. Cl.

| | |
|---|---|
| ***H01F 27/29*** | (2006.01) |
| ***H01F 27/28*** | (2006.01) |
| ***H01F 27/24*** | (2006.01) |
| ***H01F 41/04*** | (2006.01) |
| ***H01F 17/00*** | (2006.01) |
| *H01F 17/04* | (2006.01) |

(52) U.S. Cl.
CPC ..... *H01F 27/29* (2013.01); *H01F 17/0013* (2013.01); *H01F 17/0033* (2013.01);
(Continued)

(58) Field of Classification Search
CPC .... H01F 27/29; H01F 17/0013; H01F 41/046; H01F 17/0033; H01F 27/292;
(Continued)

(56) References Cited

U.S. PATENT DOCUMENTS 7,696,849 B2 * 4/2010 Ito ..... H05K 3/3442 336/192
9,142,343 B2 * 9/2015 Ohkubo ..... H01F 27/255
(Continued)

FOREIGN PATENT DOCUMENTS

CN 105849831 A 8/2016
JP H10335142 A 12/1998
(Continued)

OTHER PUBLICATIONS

An Office Action mailed by the China National Intellectual Property Administration dated Jul. 1, 2020, which corresponds to Chinese Patent Application No. 201810217655.2 and is related to U.S. Appl. No. 15/950,601 with English language translation.
(Continued)

*Primary Examiner* — Tuyen T Nguyen
(74) *Attorney, Agent, or Firm* — Studebaker & Brackett PC

(57) ABSTRACT

An electronic component comprising an element body including opposite first and second end surfaces, and an upper surface connecting the first and second end surfaces; a circuit element embedded in the element body; a first lead-out electrode embedded on the first end surface side and electrically connected to the circuit element; a columnar electrode arranged separately from the first lead-out electrode in a first direction viewed in a direction orthogonal to the first end surface, and embedded in the element body with a portion exposed from the first end surface to the upper surface; and a first via conductor connecting the first lead-out and columnar electrodes. An exposure width of the first via conductor, on the first end surface along a second direction orthogonal to the first direction viewed in the direction orthogonal to the first end surface, is smaller than the exposure width of the columnar electrode.

19 Claims, 17 Drawing Sheets

(52) U.S. Cl.
CPC ..... *H01F 27/24* (2013.01); *H01F 27/2804* (2013.01); *H01F 27/292* (2013.01); *H01F 41/041* (2013.01); *H01F 41/046* (2013.01); *H01F 2017/002* (2013.01); *H01F 2017/048* (2013.01); *H01F 2027/2809* (2013.01)

(58) Field of Classification Search
CPC .... H01F 27/2804; H01F 27/24; H01F 41/041; H01F 2017/048; H01F 2017/002; H01F 2027/2809; H05K 1/165; H05K 3/46
See application file for complete search history.

(56) References Cited

U.S. PATENT DOCUMENTS

2012/0133472 A1* 5/2012 Nishikawa ..... H01F 17/04 336/200
2013/0222101 A1* 8/2013 Ito ..... H01F 5/003 336/83
2014/0009254 A1 1/2014 Ohkubo et al.
2017/0032887 A1 2/2017 Hamada et al.

FOREIGN PATENT DOCUMENTS

JP 2014-197590 A 10/2014
WO 2015186780 A1 12/2015

OTHER PUBLICATIONS

An Office Action; "Notification of Reasons for Refusal," Mailed by the Japanese Patent Office dated Aug. 6, 2019, which corresponds to Japanese Patent Application No. 2017-088756 and is related to U.S. Appl. No. 15/950,601; with English language translation.

* cited by examiner

ELECTRONIC COMPONENT AND MANUFACTURING METHOD THEREOF

CROSS REFERENCE TO RELATED APPLICATION

This application claims benefit of priority to Japanese Patent Application 2017-088756 filed Apr. 27, 2017, the entire content of which is incorporated herein by reference.

BACKGROUND

Technical Field

The present disclosure relates to an electronic component and a manufacturing method thereof.

Background Art

Coil components serving as an example of a conventional electronic component include an electronic component described in Japanese Laid-Open Patent Publication No. 2014-197590. This electronic component has an element body, a coil embedded in the element body, a lead-out electrode embedded on the end surface side of the element body and electrically connected to the coil, and a columnar electrode embedded in the element body with a portion exposed from an end surface to an upper surface (mounting surface) of the element body. The columnar electrode is directly connected to the lead-out electrode.

SUMMARY

The present inventor found that the following problem exists when it is attempted to actually manufacture the conventional electronic component. The columnar electrode is made of Cu and is harder than the element body and extends from the lead-out electrode to the upper surface while being exposed from the end surface of the element body, so that the area of the hard columnar electrode becomes larger on the end surface of the element body. Therefore, at the time of dicing on the end surface (cut surface) of the element body in a manufacturing process of the electronic component, the volume of the columnar electrode becomes larger on the end surface side of the element body, and the load of cutting of the electronic component increases.

When the cutting load increases, a load is accordingly applied also to the electronic component side, and therefore, the columnar electrode is possibility peeled from the element body due to heat or a physical impact during or after cutting, for example. Additionally, a load on a dicing blade becomes larger and, for example, the blade may be clogged, cracked, broken, or worn away. When the cutting load increases, the load on the columnar electrode becomes larger and, for example, chipping such as cracking and breaking may occur in the columnar electrode.

Therefore, a problem to be solved by the present disclosure is to provide an electronic component capable of reducing a cutting load during dicing and a manufacturing method thereof.

In view of the problem, an embodiment of the present disclosure provides an electronic component comprising an element body including a first end surface and a second end surface opposite to each other, and an upper surface connecting the first end surface and the second end surface, a circuit element embedded in the element body, and a first lead-out electrode embedded on the first end surface side of the element body and electrically connected to the circuit element. The electronic component further comprises a columnar electrode arranged separately from the first lead-out electrode in a first direction when viewed in a direction orthogonal to the first end surface, and embedded in the element body with a portion exposed from the first end surface to the upper surface, and a first via conductor connecting the first lead-out electrode and the columnar electrode. Also, with regard to an exposure width on the first end surface along a second direction orthogonal to the first direction when viewed in the direction orthogonal to the first end surface, the exposure width of the first via conductor is smaller than the exposure width of the columnar electrode.

When "the exposure width of the first via conductor is smaller than the exposure width of the columnar electrode", this includes the case that "the exposure width of the first via conductor is zero". In other words, this includes a state in which the first via conductor is not exposed from the first end surface of the element body.

According to the electronic component of an embodiment of the present disclosure, since the first via conductor connects the first lead-out electrode and the columnar electrode, and the exposure width of the first via conductor is smaller than the exposure width of the columnar electrode, the area of the columnar electrode can be reduced on the first end surface of the element body as compared to when the columnar electrode is directly connected to the first lead-out electrode without through the first via conductor. As a result, at the time of dicing along the first end surface (cut surface) of the element body in a manufacturing process of the electronic component, the volume of the columnar electrode on the first end surface side of the element body can be decreased so that the load of cutting of the electronic component can be reduced.

In an embodiment of the electronic component, when S is an area of contact of the first via conductor with the first lead-out electrode and W is the exposure width of the columnar electrode, S/W satisfies 12.7 μm or more. According to the embodiment, since S/W satisfies 12.7 μm or more, the columnar electrode can be prevented from peeling from the element body due to peeling occurring between the first via conductor and the first lead-out electrode at a dicing step.

In an embodiment of the electronic component, the first via conductor is one of a plurality of first via conductors, and a sum of the exposure widths of the plurality of first via conductors is smaller than the exposure width of the columnar electrode. According to the embodiment, the sum of the exposure widths of the plurality of first via conductors is smaller than the exposure width of the columnar electrode. Even if a plurality of the first via conductors exists in this way, the load of cutting of the electronic component can be reduced when the sum of the exposure widths is smaller than the exposure width of the columnar electrode. Additionally, by dispersing the plurality of the first via conductors, the volumes of the first via conductors arranged in series can be made smaller to reduce a local cutting load during dicing.

In an embodiment of the electronic component, the exposure widths of the plurality of first via conductors are the same as each other, and the plurality of first via conductors are arranged at equal intervals in the second direction. According to the embodiment, the exposure widths of the plurality of first via conductors are the same as each other and the plurality of first via conductors are arranged at equal intervals. As a result, the adhesion force between the columnar electrode and the first lead-out electrode can be prevented from locally decreasing during dicing, so as to suppress local peeling of the columnar electrode during dicing.

In an embodiment, the electronic component comprises a second lead-out electrode embedded on the first end surface side in the element body and disposed separately from the first lead-out electrode toward the side opposite to the first direction, and a second via conductor connecting the first lead-out electrode and the second lead-out electrode. The exposure width of the second via conductor is smaller than the exposure width of the columnar electrode. When "the exposure width of the second via conductor is smaller than the exposure width of the columnar electrode", this includes the case that "the exposure width of the second via conductor is zero". In other words, this includes a state in which the second via conductor is not exposed from the first end surface of the element body.

According to the embodiment, since the exposure width of the second via conductor is smaller than the exposure width of the columnar electrode, the area of the second via conductor can be reduced on the first end surface of the element body as compared to when the first lead-out electrode and the second lead-out electrode are connected through the same exposure width as the columnar electrode. As a result, at the time of dicing along the first end surface (cut surface) of the element body in the manufacturing process of the electronic component, the volume of the second via conductor on the first end surface side of the element body can be decreased so that the load of cutting of the electronic component can be reduced.

In an embodiment of the electronic component, the second via conductor is one of a plurality of second via conductors, and a sum of the exposure widths of the plurality of second via conductors is smaller than the exposure width of the columnar electrode. According to the embodiment, the sum of the exposure widths of the plurality of second via conductors is smaller than the exposure width of the columnar electrode. Even if a plurality of the second via conductors exists in this way, the load of cutting of the electronic component can be reduced when the sum of the exposure widths is smaller than the exposure width of the columnar electrode. Additionally, by dispersing the plurality of the second via conductors, the volumes of the second via conductors arranged in series can be made smaller to reduce a local cutting load during dicing.

In an embodiment of the electronic component, the exposure widths of the plurality of second via conductors are the same as each other, and the plurality of second via conductors are arranged at equal intervals in the second direction. According to the embodiment, the exposure widths of the plurality of second via conductors are the same as each other and the plurality of second via conductors are arranged at equal intervals. As a result, a local cutting load during dicing can be reduced. Additionally, the adhesion force between the first lead-out electrode and the second lead-out electrode can be restrained from locally decreasing.

In an embodiment of the electronic component, the first via conductor and the second via conductor are not arranged in line along the first direction. According to the embodiment, since the first via conductor and the second via conductor are not arranged in line along the first direction, the volumes of the conductors arranged in series in the first direction are reduced, so that a local cutting load during dicing can be reduced.

In an embodiment of the electronic component, a portion of the first via conductor and a portion of the first lead-out electrode are exposed from the first end surface. According to the embodiment, a portion of the first via conductor and a portion of the first lead-out electrode are exposed from the first end surface of the element body, so that when the upper surface side of the electronic component is mounted by soldering, a solder fillet can be formed along the columnar electrode, the first via conductor, and the first lead-out electrode on the first end surface side. Therefore, the fixing strength becomes larger when the electronic component is mounted.

In an embodiment of the electronic component, a portion of the second via conductor and a portion of the second lead-out electrode are exposed from the first end surface. According to the embodiment, a portion of the second via conductor and a portion of the second lead-out electrode are exposed from the first end surface of the element body, so that when the upper surface side of the electronic component is mounted by soldering, a solder fillet can be formed along the columnar electrode, the first via conductor, the first lead-out electrode, the second via conductor, and the second lead-out electrode. Therefore, the fixing strength becomes larger when the electronic component is mounted.

In an embodiment of the electronic component, the exposure widths of the first via conductor and the second via conductor are zero. According to the embodiment, since the first via conductor and the second via conductor are not exposed from the first end surface of the element body, the volumes of the conductors can be decreased on the first end surface side of the element body, so that the load of cutting during dicing can be reduced.

In an embodiment of the electronic component, the circuit element is an inductor, the element body is made of a magnetic material and an insulator, the columnar electrode is in the magnetic material, and the first lead-out electrode, the first via conductor, and the inductor are in the insulator. According to the embodiment, a cutting load can be reduced in the electronic component having an inductor built-in. Particularly, since the inductor tends to have an increased cross-sectional area of the columnar electrode so as to reduce a DC resistance component in the element and the cutting load tends to become larger, the cutting load reduction effect becomes more significant.

In an embodiment, the electronic component further comprises a first lead-out electrode embedded on the second end surface side of the element body and electrically connected to the circuit element, a columnar electrode arranged separately from the first lead-out electrode on the second end surface side in the first direction, and embedded in the element body with a portion exposed from the second end surface to the upper surface, and a first via conductor connecting the first lead-out electrode and the columnar electrode on the second end surface side. With regard to a second exposure width on the second end surface along the second direction, the second exposure width of the first via conductor on the second end surface side is smaller than the second exposure width of the columnar electrode on the second end surface side.

According to the embodiment, since the first via conductor connects the first lead-out electrode and the columnar electrode, and the exposure width of the first via conductor is smaller than the exposure width of the columnar electrode on the second end surface side of the element body, the area of the columnar electrode can be reduced on the second end surface of the element body as compared to when the columnar electrode is directly connected to the first lead-out electrode without through the first via conductor. As a result, at the time of dicing along the second end surface (cut surface) of the element body in the manufacturing process of the electronic component, the volume of the columnar electrode on the second end surface side of the element body can be decreased so that the load of cutting of the electronic component can be reduced.

In an embodiment of the electronic component, a first end of the inductor is electrically connected to the first lead-out electrode on the first end surface side, and a second end of the inductor is electrically connected to the first lead-out electrode on the second end surface side. According to the embodiment, the first and second ends of the inductor are led out through the first lead-out electrode, the first via conductor, and the columnar electrode to the upper surface on the first end surface side and the second end surface side, respectively, so that the surface-mounted type electronic component with the built-in inductor is formed.

In an embodiment of the electronic component, the circuit element is a laminated inductor made up of a plurality of spiral wirings formed into a spiral shape in a plane parallel to the upper surface, the element body is made of a magnetic material and an insulator, the columnar electrode is in the magnetic material, and the first lead-out electrode, the first via conductor, the second lead-out electrode, the second via conductor, and the inductor are in the insulator. According to the embodiment, the electronic component is constituted by a laminated configuration, and the cutting load can be reduced in the small low-profile electronic component with the built-in inductor.

In an embodiment, the electronic component further comprises a first lead-out electrode embedded on the second end surface side of the element body and electrically connected to the circuit element, a second lead-out electrode embedded on the second end surface side in the element body and disposed separately from the first lead-out electrode on the second end surface side toward the side opposite to the first direction, and a columnar electrode arranged separately from the first lead-out electrode on the second end surface side in the first direction, and embedded in the element body with a portion exposed from the second end surface to the upper surface. The electronic component also comprises a first via conductor connecting the first lead-out electrode and the columnar electrode on the second end surface side, and a second via conductor connecting the first lead-out electrode and the second lead-out electrode on the second end surface side. With regard to a second exposure width on the second end surface along the second direction, the second exposure width of the first via conductor on the second end surface side and the second exposure width of the second via conductor on the second end surface side are smaller than the second exposure width of the columnar electrode on the second end surface side.

According to the embodiment, since the first via conductor connects the first lead-out electrode and the columnar electrode, and the exposure width of the first via conductor is smaller than the exposure width of the columnar electrode on the second end surface side of the element body, the area of the columnar electrode can be reduced on the second end surface of the element body as compared to when the columnar electrode is directly connected to the first lead-out electrode without through the first via conductor. As a result, at the time of dicing along the second end surface (cut surface) of the element body in the manufacturing process of the electronic component, the volume of the columnar electrode on the second end surface side of the element body can be decreased so that the load of cutting of the electronic component can be reduced.

Additionally, since the exposure width of the second via conductor is smaller than the exposure width of the columnar electrode on the second end surface side of the element body, the area of the second via conductor can be reduced on the second end surface of the element body as compared to when the first lead-out electrode and the second lead-out electrode are connected through the same exposure width as the columnar electrode. As a result, at the time of dicing along the second end surface (cut surface) of the element body in the manufacturing process of the electronic component, the volume of the second via conductor on the second end surface side of the element body can be decreased so that the load of cutting of the electronic component can be reduced.

In an embodiment of the electronic component, a first end of the inductor is electrically connected to the first lead-out electrode or the second lead-out electrode on the first end surface side, and a second end of the inductor is electrically connected to the first lead-out electrode or the second lead-out electrode on the second end surface side. According to the embodiment, the surface-mounted type small low-profile electronic component with the built-in inductor is formed.

An embodiment of the present disclosure provides a manufacturing method of an electronic component, comprising a step of forming a mother element body by laminating insulating layers in a first direction, and a step of forming a circuit element and a first lead-out electrode electrically connected to the circuit element on the insulating layers. The manufacturing method further comprises a step of forming a first via conductor on the first lead-out electrode, a step of forming a columnar electrode on the first via conductor such that the columnar electrode is exposed from an upper surface of the mother element body, and a cut step of cutting the mother element body along a cut surface parallel to the first direction and intersecting with the columnar electrode. At the step of forming the first via conductor, with regard to an exposure width in the cut surface along a second direction orthogonal to the first direction when viewed in a direction orthogonal to the cut surface of the mother element body, the first via conductor is formed such that the exposure width of the first via conductor becomes smaller than the exposure width of the columnar electrode.

When "the first via conductor is formed such that the exposure width of the first via conductor becomes smaller than the exposure width of the columnar electrode", this includes the case that "the exposure width of the first via conductor is set to zero". In other words, this includes forming the first via conductor at a position where the first via conductor is not exposed from the cut surface of the element body after the cut step.

According to the manufacturing method of an electronic component of one embodiment of the present disclosure, the first via conductor is formed such that the exposure width of the first via conductor becomes smaller than the exposure width of the columnar electrode. As a result, the area of the columnar electrode can be reduced on the cut surface of the element body as compared to when the columnar electrode is directly connected to the lead-out electrode without through the first via conductor. Therefore, at the time of dicing along the cut surface (end surface) of the element body in a manufacturing process of the electronic component, the volume of the columnar electrode on the cut surface side of the element body can be decreased so that the cutting load at the cut step can be reduced.

According to the electronic component of an embodiment of the present disclosure, since the first via conductor is disposed between the first lead-out electrode and the columnar electrode, and the exposure width of the first via conductor is smaller than the exposure width of the columnar electrode, the cutting load of the electronic component can be reduced during dicing. According to the manufacturing method of an electronic component of an embodiment of the present disclosure, since the first via conductor is formed such that the exposure width of the first via conductor becomes smaller than the exposure width of the columnar electrode, the cutting load at the cut step can be reduced.

DETAILED DESCRIPTION

An aspect of the present disclosure will now be described in detail with reference to the embodiments as shown in the Figures.

First Embodiment

Figure 1:
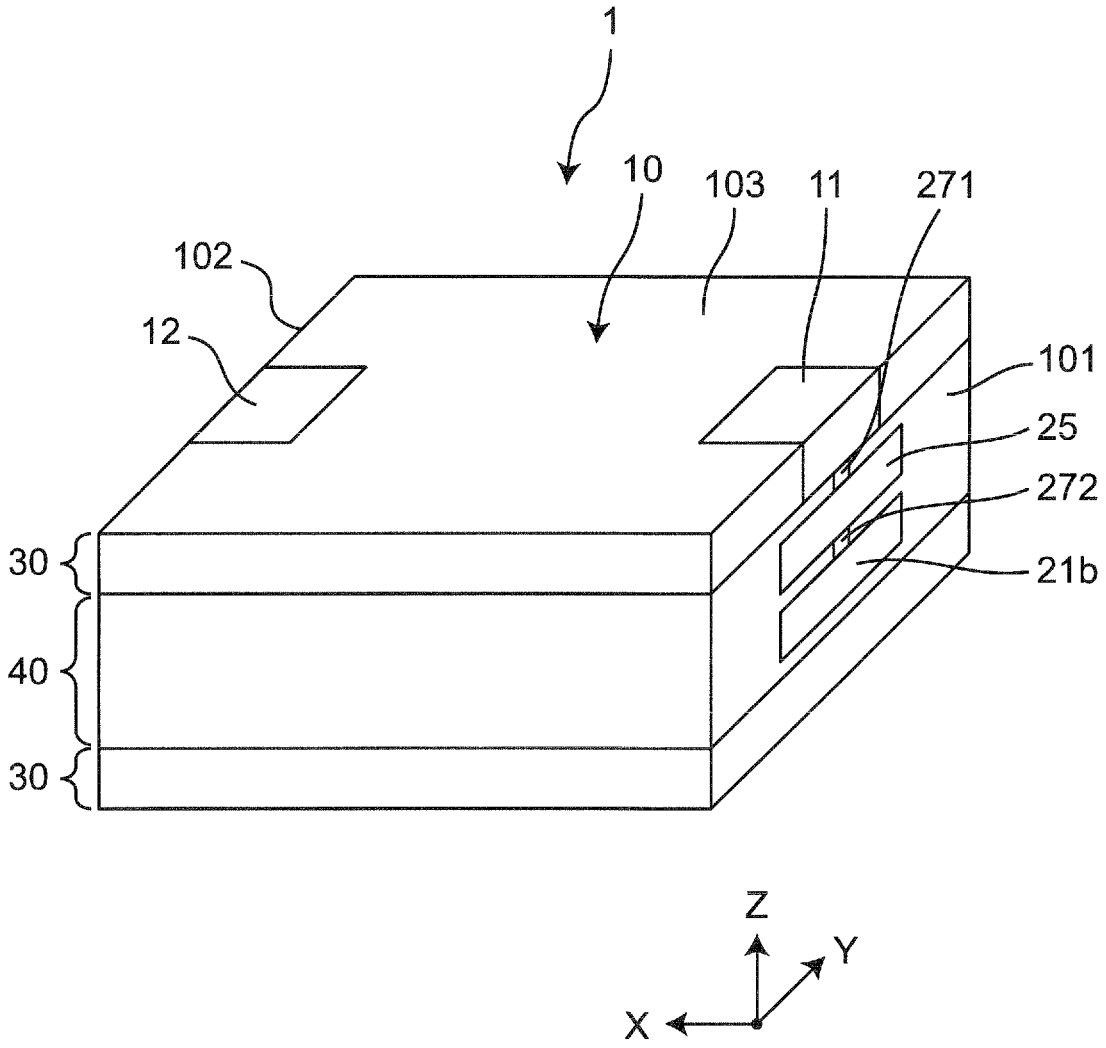
FIG. 1 is a perspective view of a first embodiment of an electronic component.
Figure 2:
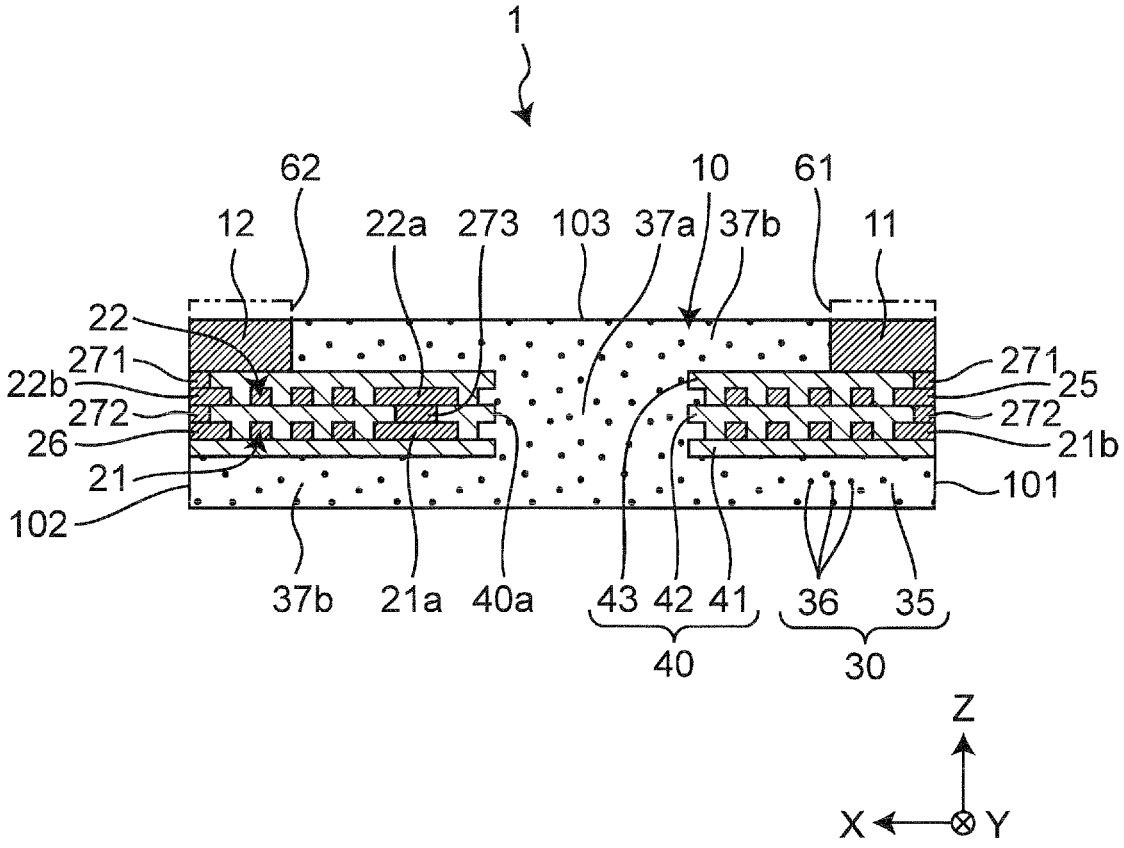
FIG. 2 is an XZ cross-sectional view of the electronic component.

FIG. 1 is a perspective view of a first embodiment of an electronic component that is an embodiment of the present disclosure. FIG. 2 is an XZ cross-sectional view of the electronic component. FIGS. 1 and 2 show a coil component 1 as an example of an electronic component. The coil component 1 is mounted on an electronic device such as a personal computer, a DVD player, a digital camera, a TV, a portable telephone, and automotive electronics, for example, and is a component generally having a rectangular parallelepiped shape, for example. However, the shape of the coil component 1 is not particularly limited and may be a circular columnar shape, a polygonal columnar shape, a truncated cone shape, or a truncated polygonal pyramid shape.

As shown in FIGS. 1 and 2, the coil component 1 has an element body 10, a first spiral wiring 21 and a second spiral wiring 22 embedded in the element body 10, first lead-out electrodes 22*b*, 25 and second lead-out electrodes 21*b*, 26, a first columnar electrode 11 and a second columnar electrode 12, and a first via conductor 271 and a second via conductor 272.

The element body 10 includes a first end surface 101 and a second end surface 102 opposite to each other, and an upper surface 103 connecting the first and second end surfaces 101, 102 to each other. The element body 10 is formed into a substantially rectangular parallelepiped shape and has a length, a width, and a height. A length direction of the element body 10, a width direction of the element body 10, and a height direction of the element body 10 are defined as an X direction, a Y direction, and a Z direction, respectively. The first end surface 101 and the second end surface 102 are arranged in the X direction and the upper surface 103 is arranged in the Z direction.

The element body 10 has an insulator 40 and a magnetic body 30 covering the insulator 40. The insulator 40 is made up of first to third insulating layers 41 to 43 having an inner diameter hole portion 40*a* in the center. The first to third insulating layers 41 to 43 are laminated in order from the lower layer to the upper layer. In this description, the upper and lower sides of the coil component 1 are described as being coincident with the upper and lower sides (in the Z direction) on the plane of FIG. 1. The Z direction coincides with the stacking direction of the layers (lamination direction). In the following description, the +Z direction and the −Z direction of FIG. 1 are described as an "upper side" and a "lower side", respectively, in some cases. Similarly in the following description, in an XY plane formed by the X direction and the Y direction, the center side of the element body 10 and the peripheral edge side of the element body 10 are described as an "inner side" and an "outer side", respectively, in some cases.

The insulator 40 is made of a composite material of an inorganic filler and a resin. The resin is an organic insulating material made of epoxy-based resin, bismaleimide, liquid crystal polymer, or polyimide, for example The inorganic filler is an insulating layer of $SiO_2$ etc. The insulator 40 is not limited to the composite material and may be made only of a resin.

The magnetic body 30 is made of a composite material of a resin 35 and a metal magnetic powder 36. The resin 35 is an organic insulating material made of epoxy-based resin, bismaleimide, liquid crystal polymer, or polyimide, for example The metal magnetic powder 36 is, for example, an FeSi alloy such as FeSiCr, an FeCo alloy, an Fe alloy such as NiFe, or an amorphous alloy thereof.

The magnetic body 30 has an inner magnetic path 37*a* and an outer magnetic path 37*b*. The inner magnetic path 37*a* is located in the inner diameter of the first and second spiral wirings 21, 22 and the inner diameter hole portion 40*a* of the insulator 40. The outer magnetic path 37*b* is located above and below the first and second spiral wirings 21, 22 and the insulator 40. Although not shown, the external magnetic path 37*b* may also be located in portions (such as the four corners of the element body 10) on the outside of the first and second spiral wirings 21, 22 and the insulator.

The first and second spiral wirings 21, 22 are each formed into a spiral shape on the XY plane. The first spiral wiring 21 is formed into a spiral shape swirling clockwise and away from the center when viewed from above, for example. The second spiral wiring 22 is formed into a spiral shape swirling counterclockwise and away from the center when viewed from above, for example.

The first spiral wiring 21 is laminated on the first insulating layer 41. The second insulating layer 42 is laminated on the first spiral wiring 21 to cover the first spiral wiring 21. The second spiral wiring 22 is laminated on the second insulating layer 42. The third insulating layer 43 is laminated on the second spiral wiring 22 to cover the second spiral wiring 22. In this way, the first and second spiral wirings 21, 22 and the multiple insulating layers are alternately laminated. In other words, each of the first and second spiral wirings 21, 22 is laminated on an insulating layer and covered by an insulating layer upper than the insulating layer.

The second spiral wiring 22 is electrically connected to the first spiral wiring 21 through a via conductor 273 extending in the lamination direction. The via conductor 273 is disposed in the second insulating layer 42. An inner circumferential portion 21*a* of the first spiral wiring 21 and an inner circumferential portion 22*a* of the second spiral wiring 22 are electrically connected through the via conductor 273. As a result, the first spiral wiring 21, the second spiral wiring 22, and the via conductor 273 form one inductor embedded in the element body 10 such that an outer circumferential end of the first spiral wiring 21 and an outer circumferential end of the second spiral wiring 22 serve as one end and the other end, respectively. Therefore, the coil component 1 includes an inductor made up of the first spiral wiring 21, the second spiral wiring 22, and the via conductor 273, as a circuit element embedded in the element body 10. The number of turns of the inductor made up of the first and second spiral wirings 21, 22 is, for example, one or more and ten or less, preferably 1.5 to 5 or less.

The first lead-out electrodes 25, 22*b* are laminated on the second insulating layer 42 and embedded on the first end surface 101 side and the second end surface 102 side, respectively, of the element body 10 with respect to the second spiral wiring 22. The first lead-out electrodes 25, 22*b* have portions (surfaces on the outer side) exposed from the first and second end surfaces 101, 102, respectively. Although not shown, the first lead-out electrode 22*b* is electrically connected to the outer circumferential end of the second spiral wiring 22, i.e., the other end of the inductor. As a result, the first lead-out electrode 22*b* has a role of leading out the other end of the inductor toward the second end surface 102 of the element body 10. Similarly, the first lead-out electrode 25 is electrically connected to the outer circumferential end of the first spiral wiring 21, i.e., the one end of the inductor through the second via conductor 272 and the second lead-out electrode 21*b* described later. As a result, the first lead-out electrode 25 has a role of leading out the one end of the inductor toward the first end surface 101 of the element body 10. The first lead-out electrode 25 is not connected on the second insulating layer 42 to the second spiral wiring 22 laminated on the same second insulating layer 42 and once goes through the first spiral wiring 21 and via conductor 273 before being connected to the inner circumferential portion 22*a* side of the second spiral wiring 22.

The second lead-out electrodes 21*b*, 26 are laminated on the first insulating layer 41 and embedded on the first end surface 101 side and the second end surface 102 side, respectively, of the element body 10 with respect to the first spiral wiring 21. The second lead-out electrodes 21*b*, 26 have portions (surfaces on the outer side) exposed from the first and second end surfaces 101, 102, respectively. The second lead-out electrode 21*b* is electrically connected to the outer circumferential end of the first spiral wiring 21, i.e., the one end of the inductor, and is electrically connected to the first lead-out electrode 25 located above, through the second via conductor 272 disposed in the second insulating layer 42. The second lead-out electrode 26 is electrically connected to the first lead-out electrode 22*b* located above, through the second via conductor 272 disposed in the second insulating layer 42. The second lead-out electrode 26 is not connected on the first insulating layer 41 to the first spiral wiring 21 laminated on the same first insulating layer 41. Although the second lead-out electrode 26 is not essential in terms of an electric circuit, the arrangement as described above makes a structure of the coil component 1 inside the element body 10 line-symmetric in the Y direction and therefore can suppress deterioration of characteristics and reliability due to localized configuration. Additionally, when the coil component 1 is mounted, the second lead-out electrode 26 can make a fillet height of solder adhering to the coil component 1 equal on the first end surface 101 side and the second end surface 102 side, so that a tombstone phenomenon can be restrained from occurring due to a difference in the fillet height.

The first and second columnar electrodes 11, 12 are disposed above the first and second spiral wirings 21, 22 in the lamination direction. The first columnar electrode 11 is located on the first end surface 101 side of the element body 10. The second columnar electrode 12 is located on the second end surface 102 side of the element body 10.

The first columnar electrode 11 is embedded in the magnetic body 30 (the external magnetic path 37*b*) of the element body 10 with a portion (an upper surface) exposed from the first end surface 101 side to the upper surface 103 of the element body 10. The second columnar electrode 12 is embedded in the magnetic body 30 (the external magnetic path 37*b*) of the element body 10 with a portion (an upper surface) exposed from the second end surface 102 side to the upper surface 103 of the element body 10.

The first columnar electrode 11 is electrically connected to the outer circumferential end of the first spiral wiring 21 (the one end of the inductor) through the first via conductor 271, the first lead-out electrode 25, the second via conductor 272, and the second lead-out electrode 21*b* described later. The second columnar electrode 12 is electrically connected to the outer circumferential end of the second spiral wiring 22 (the other end of the inductor) through the first via conductor 271 and the first lead-out electrode 22*b* described later. A first covering layer 61 and a second covering layer 62 may be disposed on the upper surface of the first columnar electrode 11 and the upper surface of the second columnar electrode 12, respectively. The first and second covering layers 61, 62 are films covering the first and second columnar electrodes 11, 12, and are made of, for example, Sn, Ni, Cu, Au, and alloys containing these. When the coil component 1 is mounted on a mounting substrate, the first and second covering films 61, 62 are connected via solder to lands of the mounting substrate and can thereby improve mountability, conductivity, solder resistance, solder wettability, etc. of the coil component 1. In this description, even in the case of being covered with another embodiment such as when the first and second covering films 61, 62 are disposed on the upper surfaces of the first and second columnar electrodes 11, 12, this is expressed as "being exposed from the element body". Therefore, "exposure" in this description does not refer only to the case of direct exposure to the outside of the electronic component.

The first via conductor 271 is located between the first lead-out electrode 25 and the first columnar electrode 11 on the first end surface 101 side of the element body 10 to electrically connect the first lead-out electrode 25 and the first columnar electrode 11. The first via conductor 271 is located between the first lead-out electrode 22*b* and the second columnar electrode 12 on the second end surface 102 side of the element body 10 to electrically connect the first lead-out electrode 22*b* and the second columnar electrode 12. A portion (surface on the outer side) of the first via conductor 271 is exposed from the first end surface 101 and the second end surface 102 of the element body 10.

The second via conductor 272 is located between the first lead-out electrode 25 and the second lead-out electrode 21*b* on the first end surface 101 side of the element body 10 to electrically connect the first lead-out electrode 25 and the second lead-out electrode 21*b*. The second via conductor 271 is located between the first lead-out electrode 22*b* and the second lead-out electrode 26 on the second end surface 102 side of the element body 10 to electrically connect the first lead-out electrode 22*b* and the second lead-out electrode 26. A portion (surface on the outer side) of second via conductor 272 is exposed from the first end surface 101 and the second end surface 102 of the element body 10. The via conductor 273 is located between the inner circumferential portion 21*a* of the first spiral wiring 21 and the inner circumferential portion 22*a* of the second spiral wiring 22 on the inner circumferential side of the element body 10 to electrically connect the inner circumferential portion 21*a* and the inner circumferential portion 22*a*.

The first and second spiral wirings 21, 22, the first and second lead-out electrodes 22*b*, 25, 21*b*, 26, the first and second columnar electrodes 11, 12, the first and second via conductors 271, 272 are made of low-resistance metal such as Cu, Ag, and Au, for example. Preferably, low-resistance and narrow-pitch spiral wirings can be formed by using Cu plating formed by a semi-additive method.

Figure 3:
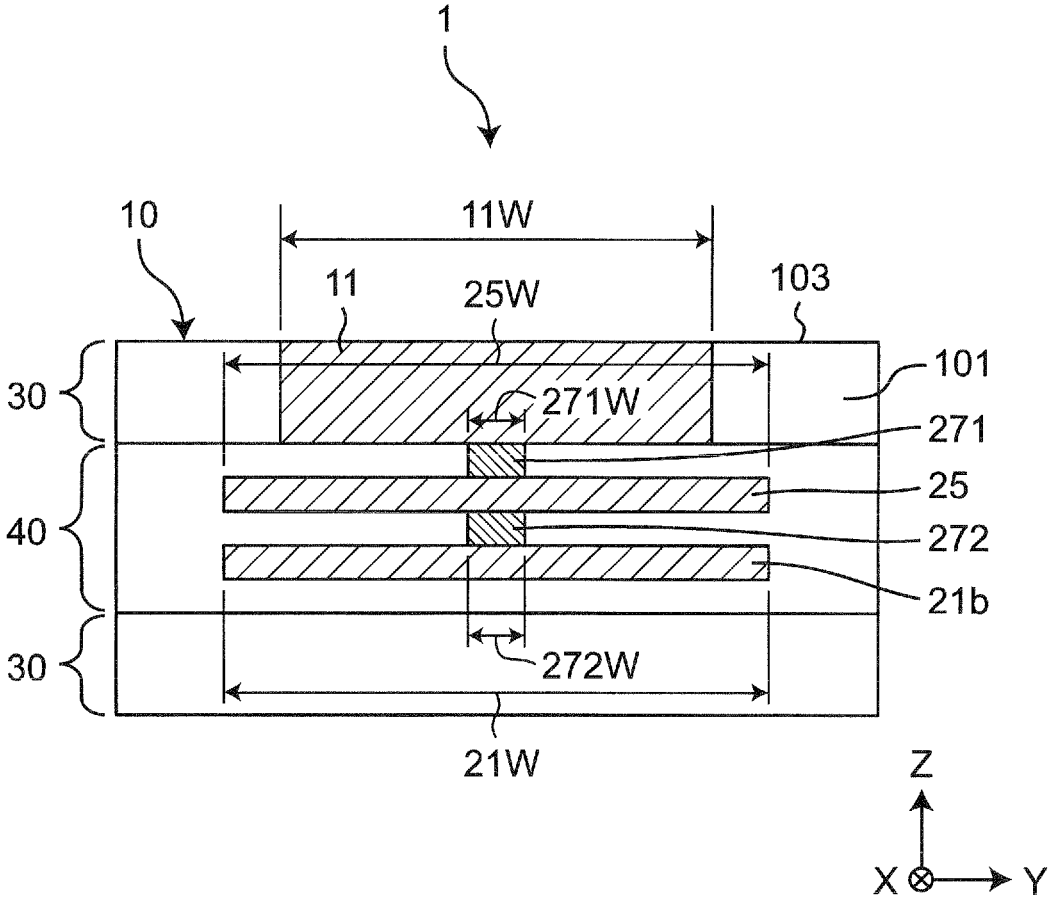
FIG. 3 is a view on an X-direction arrow of the electronic component.

A connection structure on the first end surface 101 side and the second end surface 102 side of the coil component 1 will be described. FIG. 3 is a view on an X-direction arrow of the electronic component. In FIG. 3, for clarity, the portions exposed from the element body 10 are indicated by hatching. As shown in FIGS. 2 and 3, the first lead-out electrode 25 is disposed on the first end surface 101 side of the element body 10, and a portion of the first lead-out electrode 25 is exposed from the first end surface 101 of the element body 10. The first columnar electrode 11 is arranged separately from the first lead-out electrode 25 in a first direction (+Z direction) that is upward in the lamination direction when viewed in the direction (X direction) orthogonal to the first end surface 101 of the element body 10.

A discussion will be made on an exposure width from the element body 10 on the first end surface 101 along a second direction (Y direction) orthogonal to the first direction when viewed in the direction orthogonal to the first end surface 101 of the element body 10. An exposure width 271W of the first via conductor 271 is smaller than an exposure width 11W of the first columnar electrode 11.

In the coil component 1, the first via conductor 271 is exposed from the first end surface 101 and, in this description, when "the exposure width 271W of the first via conductor 271 is smaller than the exposure width 11W of the first columnar electrode 11", this includes the case that "the exposure width 271W of the first via conductor 271 is zero". In other words, even if the first via conductor 271 is not exposed from the first end surface 101 of the element body 10, it is satisfied that "the exposure width 271W of the first via conductor 271 is smaller than the exposure width 11W of the first columnar electrode 11".

The exposure width 271W of the first via conductor 271 is smaller than an exposure width 25W of the first lead-out electrode 25. As a result, the first via conductor 271 can be improved in formation stability on the first lead-out electrode 25 and a degree of freedom is improved in the size and the arrangement location of the first via conductor 271. The exposure width 25W of the first lead-out electrode 25 is larger than, or may be smaller than, the exposure width 11W of the first columnar electrode 11, and the exposure width 25W of the first lead-out electrode 25 may be zero. When the exposure width 25W of the first lead-out electrode 25 is larger than the exposure width 11W of the first columnar electrode 11, a large exposure width can be ensured for the electrode on the lower side in the manufacturing process, and the electrode on the upper side can be improved in formation stability. When the exposure width 25W of the first lead-out electrode 25 is smaller than the exposure width 11W of the first columnar electrode 11, the first columnar electrode 11 becomes relatively large, so that the mountability of the coil component 1 is improved.

Further, when viewed in the direction orthogonal to the first end surface 101 of the element body 10, the second lead-out electrode 21*b* is disposed separately from the first lead-out electrode 25 on the side (in the −Z direction) opposite to the first direction. An exposure width 272W of the second via conductor 272 is smaller than the exposure width 11W of the first columnar electrode 11.

In the coil component 1, the second via conductor 272 is exposed from the first end surface 101 and, in this description, when "the exposure width 272W of the second via conductor 272 is smaller than the exposure width 11W of the first columnar electrode 11", this includes the case that "the exposure width 272W of the second via conductor 272 is zero". In other words, even if the second via conductor 272 is not exposed from the first end surface 101 of the element body 10, it is satisfied that "the exposure width 272 W of the second via conductor 272 is smaller than the exposure width 11W of the first columnar electrode 11".

The exposure width 272W of the second via conductor 272 is smaller than the exposure width 21W of the second lead-out electrode 21*b*. As a result, the second via conductor 272 can be improved in formation stability on the second lead-out electrode 21*b* and a degree of freedom is improved in the size and the arrangement location of the second via conductor 272. The exposure width 21W of the second lead-out electrode 21*b* is larger than, or may be smaller than, the exposure width 11W of the first columnar electrode 11. The exposure width 272W of the second via conductor 272 is the same as, or may be different from, the exposure width 271W of the first via conductor 271. When the exposure width 21W of the second lead-out electrode 21*b* is larger than the exposure width 11W of the first columnar electrode 11, a large exposure width can be ensured for the electrode on the lower side in the manufacturing process, and the electrode on the upper side can be improved in formation stability. When the exposure width 21W of the second lead-out electrode 21*b* is smaller than the exposure width 11W of the first columnar electrode 11, the first columnar electrode 11 becomes relatively large, so that the mountability of the coil component 1 is improved.

Although the first end surface 101 side of the element body 10 has been described above, the same applies to the second end surface 102 side of the element body 10. Specifically, the second columnar electrode 12, the first via conductor 271, the first lead-out electrode 22*b*, the second via conductor 272, and the second lead-out electrode 26 are exposed from the second end surface 102 of the element body 10 in order from the top to the bottom (from the +Z direction to the −Z direction) in the lamination direction.

A discussion will be made on an exposure width from the element body 10 on the second end surface 102 along the second direction (Y direction) orthogonal to the first direction when viewed in the direction orthogonal to the second end surface 102 of the element body 10. The exposure width of the first via conductor 271 is smaller than the exposure width of the second columnar electrode 12. The exposure width of the second via conductor 272 is smaller than the exposure width of the second columnar electrode 12.

A manufacturing method of the coil component 1 will be described with reference to FIGS. 4A to 4K.

Figure 4A:
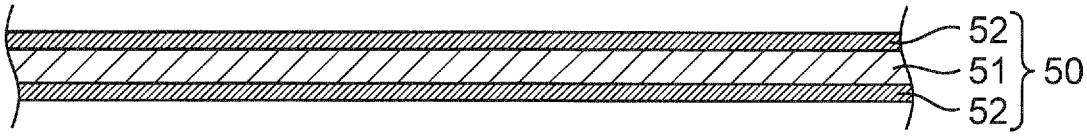
FIG. 4A is an explanatory view for explaining a manufacturing method of the electronic component.

As shown in FIG. 4A, a base 50 is prepared. In this embodiment, a plurality of the coil components 1 is manufactured from the one base 50. The base 50 has an insulating substrate 51 and base metal layers 52 disposed on both sides of the insulating substrate 51. In this embodiment, the insulating substrate 51 is a glass epoxy substrate and the base metal layers 52 are Cu foils. Since the thickness of the base 50 does not affect the thickness of the coil component 1 because the base 50 is peeled off as described later, the base with easy-to-handle thickness may be used as needed for the reason of warpage due to processing etc.

Figure 4B:
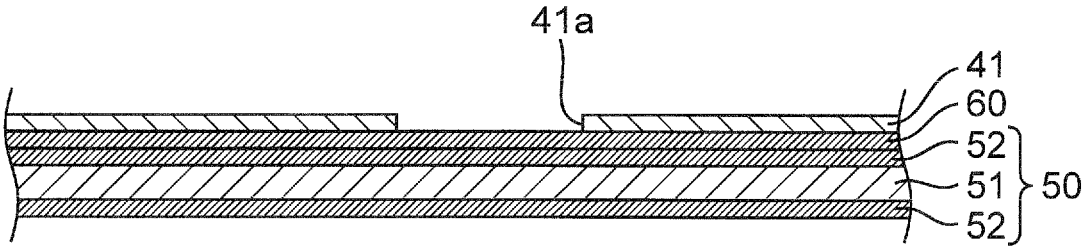
FIG. 4B is an explanatory view for explaining the manufacturing method of the electronic component.

As shown in FIG. 4B, a dummy metal layer 60 is bonded onto a surface of the base 50. In this embodiment, the dummy metal layer 60 is a Cu foil. Since the dummy metal layer 60 is bonded to the base metal layer 52 of the base 50, the dummy metal layer 60 is bonded to a smooth surface of the base metal layer 52. Therefore, an adhesion force can be made weak between the dummy metal layer 60 and the base metal layer 52 and, at a subsequent step, the base 50 can easily be peeled from the dummy metal layer 60. Preferably, an adhesive bonding the base 50 and the dummy metal layer 60 is an adhesive with low tackiness. For weakening of the adhesion force between the base 50 and the dummy metal layer 60, it is desirable that the bonding surfaces of the base 50 and the dummy metal layer 60 are glossy surfaces.

Subsequently, the first insulating layer 41 is laminated on the dummy metal layer 60 temporarily bonded to the base 50. In this case, the first insulating layer 41 is thermally press-bonded and thermally cured by a vacuum laminator, a press machine, etc. Subsequently, a portion of the first insulating layer 41 corresponding to the inner magnetic path (magnetic core) is removed by a laser etc. to form an opening portion 41*a*.

Figure 4C:
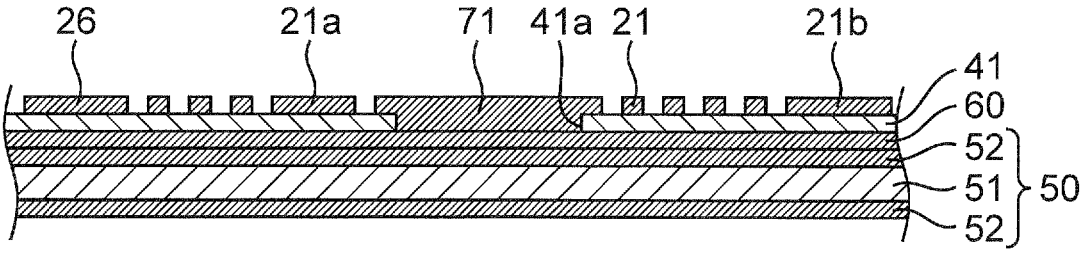
FIG. 4C is an explanatory view for explaining the manufacturing method of the electronic component.

As shown in FIG. 4C, the first spiral wiring 21 and the second lead-out electrodes 21*b*, 26 are laminated on the first insulating layer 41 by using the semi-additive method. The first spiral wiring 21 and the second connection wiring 26 are not in contact with each other. Although the first spiral wiring 21 is electrically connected to the second lead-out electrode 21*b* on the outer circumferential side, the first spiral wiring 21 and the second lead-out electrode 26 are not in contact with each other. The second connection wiring 26 is disposed on the side opposite to the second lead-out electrode 21*b*. Specifically, first, a power feeding film is formed on the first insulating layer 41 by electroless plating, sputtering, vapor deposition, etc. After formation of the power feeding film, a photosensitive resist is applied or pasted onto the power feeding film, and a wiring pattern is formed by photolithography. Subsequently, a metal wiring corresponding to the wirings 21, 26 is formed by the electrolytic plating. After the formation of the metal wiring, the photosensitive resist is peeled and removed by a chemical liquid, and the power feeding film is etched and removed. It is noted that this metal wiring can subsequently be used as a power feeding portion to acquire the wirings 21, 26 with narrower spaces by performing additional Cu electrolytic plating. In this embodiment, for example, after a Cu wiring with L (wiring width)/S (wiring space (wiring pitch))/t (wiring thickness) of 50/30/60 μm is formed by the semi-additive method, additional Cu electrolytic plating can be performed for the thickness of 10 μm to acquire the first spiral wiring 21 and the second lead-out electrodes 21*b*, 26 as the wirings of L/S/t=70/10/70 μm. A first sacrificial conductor 71 corresponding to the inner magnetic path is disposed by using the semi-additive method on the dummy metal layer 60 in the opening portion 41*a* of the first insulating layer 41.

Figure 4D:
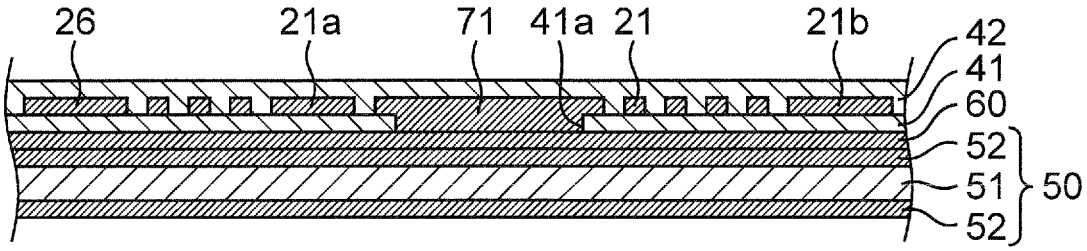
FIG. 4D is an explanatory view for explaining the manufacturing method of the electronic component.

As shown in FIG. 4D, the second insulating layer 42 is laminated on the first spiral wiring 21, the second lead-out electrodes 21*b*, 26, and the first insulating layer 41 including the first sacrificial conductor 71 to cover the first spiral wiring 21, the second lead-out electrodes 21*b*, 26, and the first sacrificial conductor 71 with the second insulating layer 42. The second insulating layer 42 is then thermally press-bonded and thermally cured by a vacuum laminator, a press machine, etc. In this case, the thickness of the second insulating layer 42 above the first spiral wiring 21 is set to 10 μm or less. As a result, the inter-layer pitch between the first and second spiral wirings 21, 22 can be set to 10 μm or less.

To ensure a filling property to the wiring pitch (e.g., 10 μm) of the first spiral wiring 21, the inorganic filler (insulator) included in the second insulating layer 42 must have a particle diameter sufficiently smaller than the wiring pitch of the first spiral wiring 21. Additionally, to achieve a thinner component, the inter-layer pitch to the subsequent upper wiring must be made as thin as 10 μm or less, for example, and therefore, also the insulator must have a sufficiently small particle diameter.

Figure 4E:
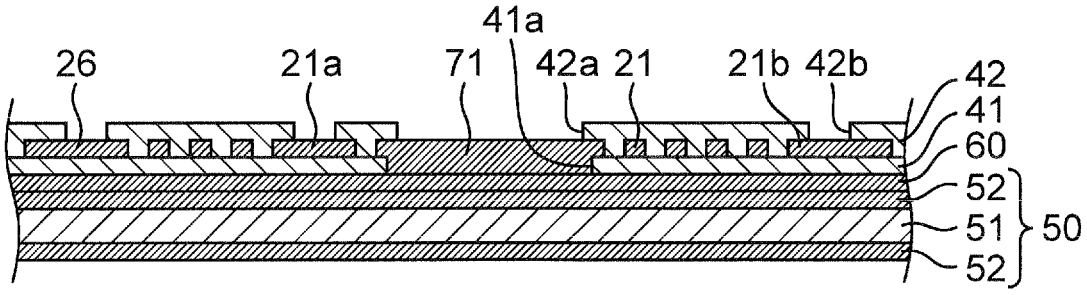
FIG. 4E is an explanatory view for explaining the manufacturing method of the electronic component.

As shown in FIG. 4E, via holes 42*b* for forming the second via conductor 272 and the via conductor 273 are formed by laser processing etc. in the second insulating layer 42 on the second lead-out electrodes 21*b*, 26 and the inner circumferential portion 21*a* of and the first spiral wiring 21. A portion of the second insulating layer 42 on the first sacrificial conductor 71 corresponding to the inner magnetic path (magnetic core) is removed by a laser etc. to form an opening portion 42*a*.

Figure 4F:
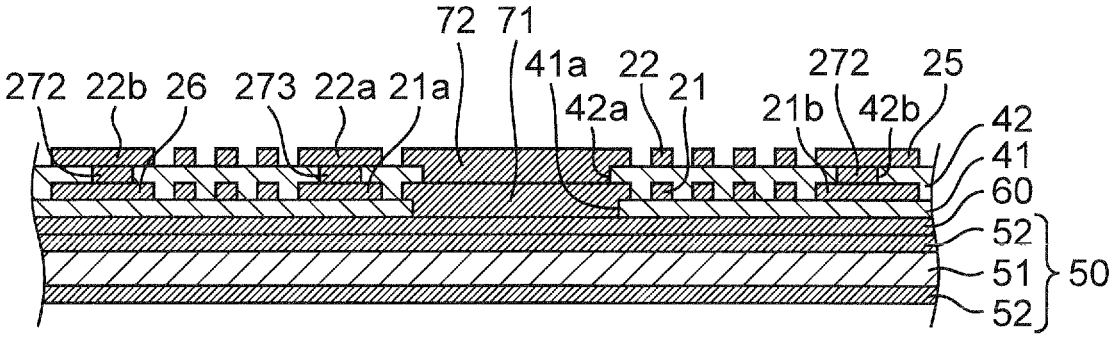
FIG. 4F is an explanatory view for explaining the manufacturing method of the electronic component.

As shown in FIG. 4F, the second via conductor 272 and the via conductor 273 are formed in the via holes, and the second spiral wiring 22 and the first lead-out electrodes 25, 22*b* are laminated on the second insulating layer 42. Although the second spiral wiring 22 is electrically connected to the first lead-out electrode 22*b* on the outer circumferential side, the second spiral wiring 22 and the first lead-out electrode 25 are not in contact with each other. The first lead-out electrode 25 is disposed on the side opposite to the first lead-out electrode 22*b*. A second sacrificial conductor 72 corresponding to the inner magnetic path is disposed on the first sacrificial conductor 71 in the opening portion

42*a* of the second insulating layer 42. In this case, the second via conductor 272, the via conductor 273, the second spiral wiring 22, the first lead-out electrodes 25, 22*b*, and the second sacrificial conductor 72 can be disposed by the same process as the first spiral wiring 21, the second lead-out electrodes 21*b*, 26, and the first sacrificial conductor 71.

Figure 4G:
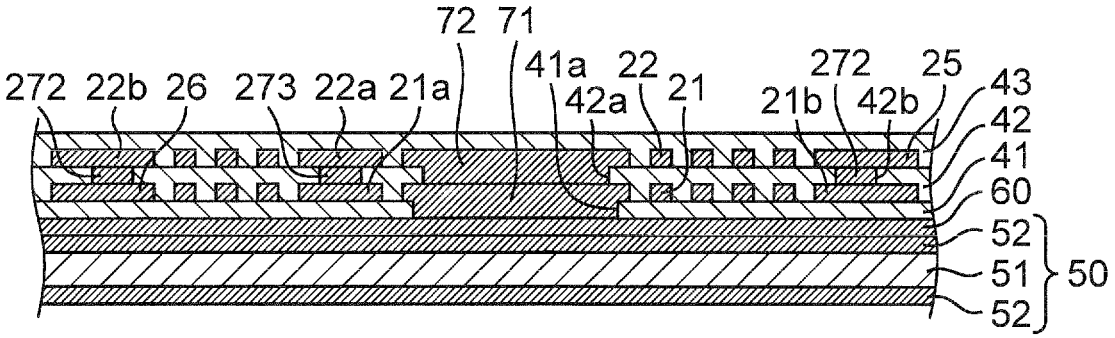
FIG. 4G is an explanatory view for explaining the manufacturing method of the electronic component.

As shown in FIG. 4G, the third insulating layer 43 is laminated on the second spiral wiring 22, the first lead-out electrodes 25, 22*b*, and the second insulating layer 42 including the second sacrificial conductor 72 to cover the second spiral wiring 22, the first lead-out electrodes 25, 22*b*, and the second sacrificial conductor 72 with the third insulating layer 43. The third insulating layer 43 is thermally press-bonded and thermally cured by a vacuum laminator, a press machine, etc.

Figure 4H:
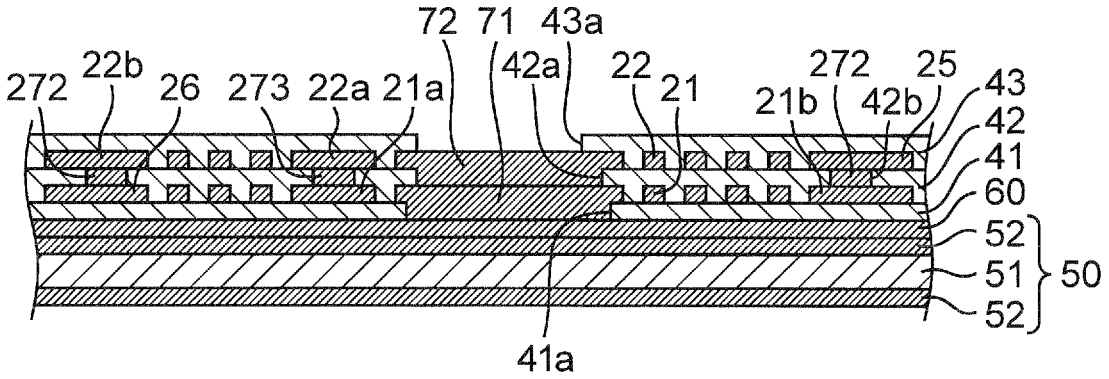
FIG. 4H is an explanatory view for explaining the manufacturing method of the electronic component.

As shown in FIG. 4H, a portion of the third insulating layer 43 on the second sacrificial conductor 72 corresponding to the inner magnetic path (magnetic core) is removed by a laser etc. to form an opening portion 43*a*.

Figure 4I:
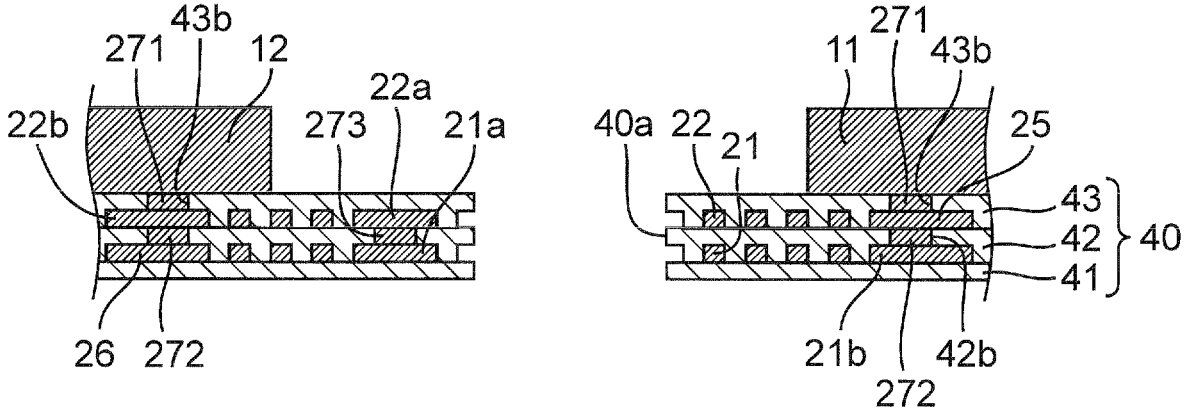
FIG. 4I is an explanatory view for explaining the manufacturing method of the electronic component.

Subsequently, the base 50 is peeled off from the dummy metal layer 60 on the bonding plane between the surface of the base 50 (the base metal layer 52) and the dummy metal layer 60. The dummy metal layer 60 is removed by etching etc., and the first and second sacrificial conductors 71, 72 are removed by etching etc., and as shown in FIG. 4I, a hole portion 40*a* corresponding to the inner magnetic path is disposed in the insulator 40. A via hole 43*b* for forming the first via conductor 271 is then formed in the third insulating layer 43 by laser processing etc. The first via conductor 271 is formed in the via hole 43*b*, and the first and second columnar electrodes 11, 12 having a columnar shape are laminated on the third insulating layer 43 including the top of the first via conductor 271. In this case, the first via conductor 271 and the first and second columnar electrodes 11, 12 can be disposed by the same process as the first spiral wiring 21. In the above description, the first via conductor 271 and the second via conductor 272 are formed such that the maximum width of the first via conductor 271 and the second via conductor 272 in the direction corresponding to the Y direction is made smaller than the maximum width of the first and second columnar electrodes 11, 12 in the direction corresponding to the Y direction. This may be achieved by adjusting a photosensitive range with a mask at the time of photolithography, for example.

Figure 4J:
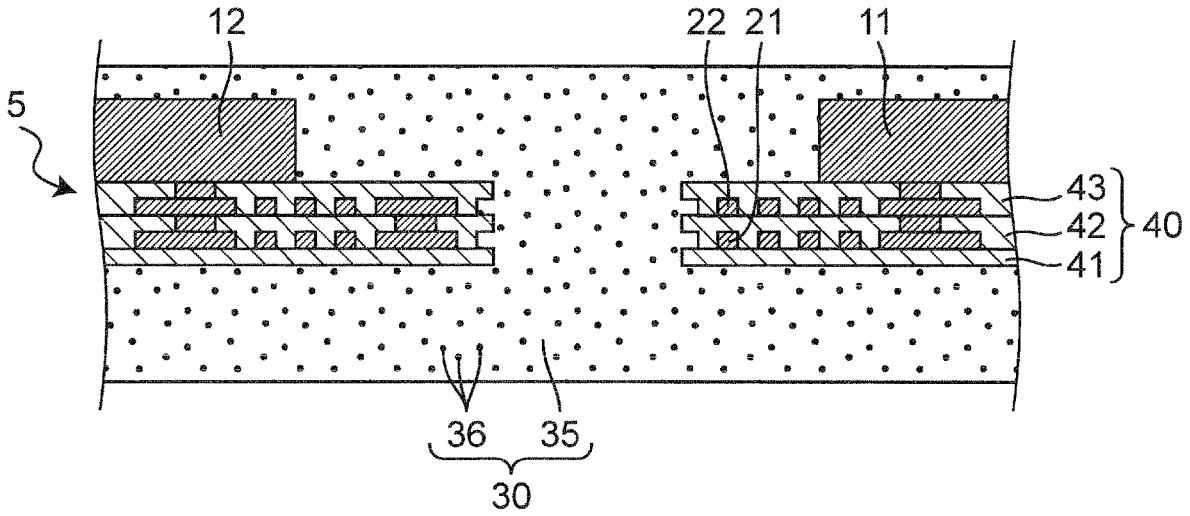
FIG. 4J is an explanatory view for explaining the manufacturing method of the electronic component.

As shown in FIG. 4J, the first and second columnar electrodes 11, 12 as well as the upper and lower surface sides of the insulator 40 are covered with the magnetic body 30 and the magnetic body 30 is thermally press-bonded and thermally cured by a vacuum laminator, a press machine, etc. to form a coil substrate 5 (mother element body). In this case, the magnetic body 30 is also filled into the hole portion 40*a* of the insulator 40.

Figure 4K:
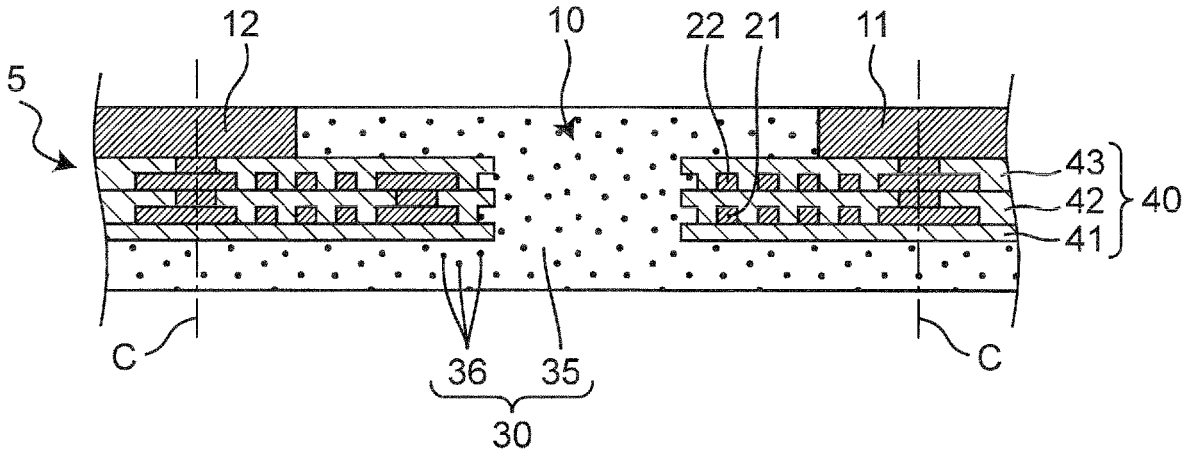
FIG. 4K is an explanatory view for explaining the manufacturing method of the electronic component.

As shown in FIG. 4K, the magnetic body 30 on the upper and lower sides of the coil substrate 5 is reduced in thickness by a grinding method. In this case, the first and second columnar electrodes 11, 12 are partially exposed so that the upper end surfaces of the first and second internal electrodes 11, 12 are located on the same plane as the upper end surface of the magnetic body 30. In this case, by grinding the magnetic body 30 to a thickness sufficient for acquiring an inductance value, the component can be made thinner. For example, in this embodiment, the thickness of the magnetic body 30 on the insulator 40 can be 20 μm. The first and second external terminals 61, 62 (see FIG. 2) are then disposed on the upper end surfaces of the first and second columnar electrodes 11, 12.

Subsequently, the coil substrate 5 (mother element body) is diced or scribed into pieces along cut surfaces C to form the single coil component 1 shown in FIG. 2. In this case, the cut surfaces C constitute the first and second end surfaces 101, 102 of the element body 10. Therefore, the first columnar electrode 11, the first via conductor 271, the first lead-out electrode 25, the second via conductor 272, and the second lead-out electrode 21*b* are exposed from the first end surface 101 of the element body 10. The second columnar electrode 12, the first via conductor 271, the first lead-out electrode 22*b*, the second via conductor 272, and the second lead-out electrode 26 are exposed from the second end surface 102 of the element body 10.

In short, the manufacturing method of this embodiment comprises: a step of forming the mother element body (the coil substrate 5) by laminating the first to third insulating layers 41 to 43 in the first direction (+Z direction); a step of forming a coil made up of the first spiral wiring 21, the via conductor 273, and the second spiral wiring 22 and the first lead-out electrodes 25, 22*b* electrically connected to one end and the other end of the coil on the first insulating layer 41; a step of forming the first via conductor 271 on the first lead-out electrodes 25, 22*b*, a step of forming the first and second columnar electrodes 11, 12 on the first via conductor 271 such that the electrodes are exposed from the upper surface of the mother element body; and a step of cutting the mother element body (the coil substrate 5) along the cut surfaces C parallel to the first direction and respectively intersecting with the first and second columnar electrodes 11, 12. At the step of forming the first via conductor 271, with regard to the exposure width on the cut surfaces C along the second direction (Y direction) orthogonal to the first direction when viewed in the direction orthogonal to the cut surfaces C of the mother element body (the coil substrate 5), the first via conductor 271 is formed such that the exposure width of the first via conductor 271 becomes smaller than the exposure widths of the first and second columnar electrodes 11, 12.

Although the coil substrate 5 is formed on one of both surfaces of the base 50 in the above description, the coil substrate 5 may be formed on each of both surfaces of the substrate 50. Alternatively, pluralities of the first and second spiral wirings 21, 22 and the insulators 40 may be formed in parallel on one surface of the base 50 and may be divided into pieces at the time of dicing so that a multiplicity of the coil substrates 5 can be formed at the same time. As a result, higher productivity can be achieved.

According to the electronic component (the coil component 1), since the first via conductor 271 connects the first lead-out electrode 25 and the first columnar electrode 11, and the exposure width 271W of the first via conductor 271 is smaller than the exposure width 11W of the first columnar electrode 11, the area of the first columnar electrode 11 can be reduced on the first end surface 101 of the element body 10 as compared to when the first columnar electrode 11 is directly connected to the first lead-out electrode 25 without through the first via conductor 271. As a result, at the time of dicing along the first end surface 101 (cut surface C) of the element body 10 in the manufacturing process of the electronic component, the volume of the first columnar electrode 11 on the first end surface 101 side of the element body 10 can be decreased so that the load of cutting of the coil component 1 can be reduced.

When the cutting load decreases in this way, the load on the electronic component (coil component 1) side also becomes smaller, and the first columnar electrode 11 is less likely to be peeled from the element body 10 due to heat or a physical impact during or after cutting, for example. Additionally, a load on a dicing blade becomes smaller and, for example, the blade can be prevented from being clogged, cracked, broken, or worn away. When the cutting load decreases, the load on the first columnar electrode 11 becomes smaller and, for example, chipping such as cracking and breaking can be prevented from occurring in the first columnar electrode 11.

The same applies to the second end surface 102 side of the element body 10. Specifically, since the exposure width of the first via conductor 271 is smaller than the exposure width of the second columnar electrode 12, the area of the second columnar electrode 12 can be reduced on the second end surface 102 of the element body 10 as compared to when the first columnar electrode 11 is directly connected to the first lead-out electrode 25 without through the first via conductor 271, so that the load of cutting of the coil component 1 can be reduced.

Since the exposure width of the second via conductor 272 is smaller than the exposure width of the first columnar electrode 11, the area of the second via conductor 272 can be reduced on the first end surface 101 of the element body 10 as compared to when the first lead-out electrode 25 and the second lead-out electrode 21*b* are connected through the same exposure width as the first columnar electrode 11. As a result, at the time of dicing along the first end surface 101 (cut surface C) of the element body 10 in the manufacturing process of the electronic component, the volume of the second via conductor 272 on the first end surface 101 side of the element body 10 can be decreased so that the load of cutting of the coil component 1 can be reduced. The same applies to the second end surface 102 side of the element body 10. Specifically, since the exposure width of the second via conductor 272 is smaller than the exposure width of the second columnar electrode 12, the area of the second via conductor 272 can be reduced on the second end surface 102 of the element body 10, so that the load of cutting of the second via conductor 272 can be reduced.

A portion of the first via conductor 271 and a portion of the first lead-out electrode 25 are exposed from the first end surface 101 of the element body 10, and a portion of the second via conductor 272 and a portion of the second lead-out electrode 21*b* are exposed from the first end surface 101 of the element body 10, so that when the first columnar electrode 11 side of the electronic component is mounted by soldering, a solder fillet can be formed along the first columnar electrode 11, the first via conductor 271, the first lead-out electrode 25, the second via conductor 272, and the second lead-out electrode 21*b*.

Similarly, a portion of the first via conductor 271 and a portion of the first lead-out electrode 22*b* are exposed from the second end surface 102 of the element body 10, and a portion of the second via conductor 272 and a portion of the second lead-out electrode 26 are exposed from the second end surface 102 of the element body 10, so that a solder fillet can be formed along the second columnar electrode 12, the first via conductor 271, the first lead-out electrode 22*b*, the second via conductor 272, and the second lead-out electrode 26. Therefore, the fixing strength becomes larger when the electronic component is mounted.

According to the manufacturing method of the electronic component, the first via conductor 271 is formed such that the exposure width of the first via conductor 271 becomes smaller than the exposure widths of the first and second columnar electrodes 11, 12. Therefore, as compared to when the first and second columnar electrodes 11, 12 are directly connected to the first lead-out electrodes 25, 22*b* without through the first via conductor 271, the areas of the first and second columnar electrodes 11, 12 can be reduced on the cut surfaces C of the element body 10. As a result, at the time of dicing along the cut surfaces C (the end surfaces 101, 120) of the element body 10 in the manufacturing process of the electronic component, the volumes of the columnar electrodes 11, 12 on the cut surface C side of the element body 10 can be decreased so that the cutting load at the cut step can be reduced.

Second Embodiment

Figure 5:
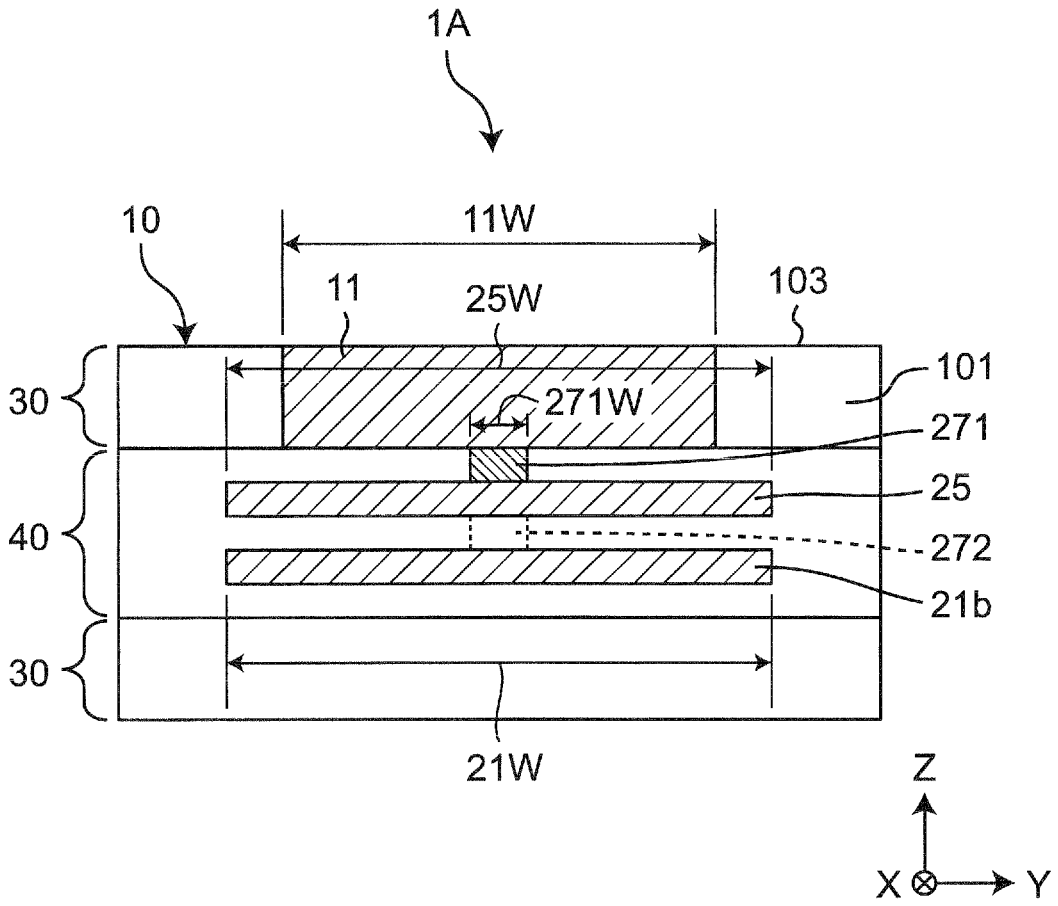
FIG. 5 is a view on the X-direction arrow of a second embodiment of the electronic component.

FIG. 5 is a view on the X-direction arrow of a second embodiment of the electronic component. In FIG. 5, for clarity, the portions exposed from the element body 10 are indicated by hatching. The second embodiment is different from the first embodiment in the configuration of the second via conductor. This different configuration will hereinafter be described. In the second embodiment, the same constituent elements as the first embodiment are denoted by the same reference numerals as the first embodiment and therefore will not be described.

As shown in FIG. 5, in a coil component 1A serving as the electronic component, the second via conductor 272 is not exposed from the first end surface 101 of the element body 10. As a result, the volume of the second via conductor 272 can be decreased on the first end surface 101 side of the element body 10, so that the load of cutting during dicing can be reduced.

Although not shown, the second via conductor 272 is not exposed from the second end surface 102 of the element body 10. Therefore, the exposure width of the second via conductor 272 is zero. As a result, the volume of the second via conductor 272 can be decreased on the second end surface 102 side of the element body 10, so that the load of cutting during dicing can be reduced. The second via conductor 272 may be exposed from the second end surface 102 of the element body 10.

Third Embodiment

Figure 6:
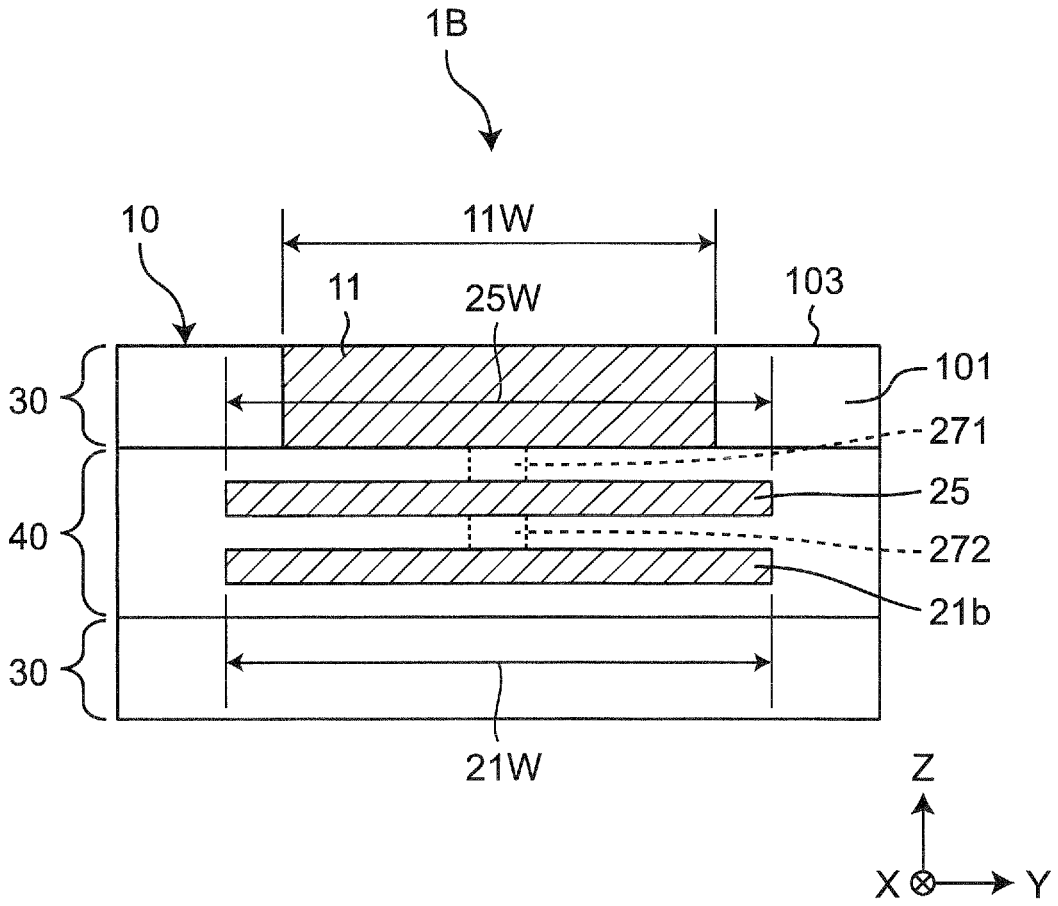
FIG. 6 is a view on the X-direction arrow of a third embodiment of the electronic component.

FIG. 6 is a view on the X-direction arrow of a third embodiment of the electronic component. In FIG. 6, for clarity, the portions exposed from the element body 10 are indicated by hatching. The third embodiment is different from the first embodiment in the configuration of the first via conductor and the second via conductor. This different configuration will hereinafter be described. In the third embodiment, the same constituent elements as the first embodiment are denoted by the same reference numerals as the first embodiment and therefore will not be described.

As shown in FIG. 6, in a coil component 1B serving as the electronic component, the first via conductor 271 and the second via conductor 272 are not exposed from the first end surface 101 of the element body 10. As a result, the volumes of the first via conductor 271 and the second via conductor 272 can be decreased on the first end surface 101 side of the element body 10, so that the load of cutting during dicing can be reduced. In this case, the exposure width of the first via conductor 271 is zero, which is obviously smaller than the exposure width 11W of the first columnar electrode 11.

Although not shown, the first via conductor 271 and the second via conductor 272 are not exposed from the second end surface 102 of the element body 10. As a result, the volumes of the first via conductor 271 and the second via conductor 272 can be decreased on the second end surface 102 side of the element body 10, so that the load of cutting during dicing can be reduced. The first via conductor 271 and the second via conductor 272 may be exposed from the second end surface 102 of the element body 10.

Fourth Embodiment

Figure 7:
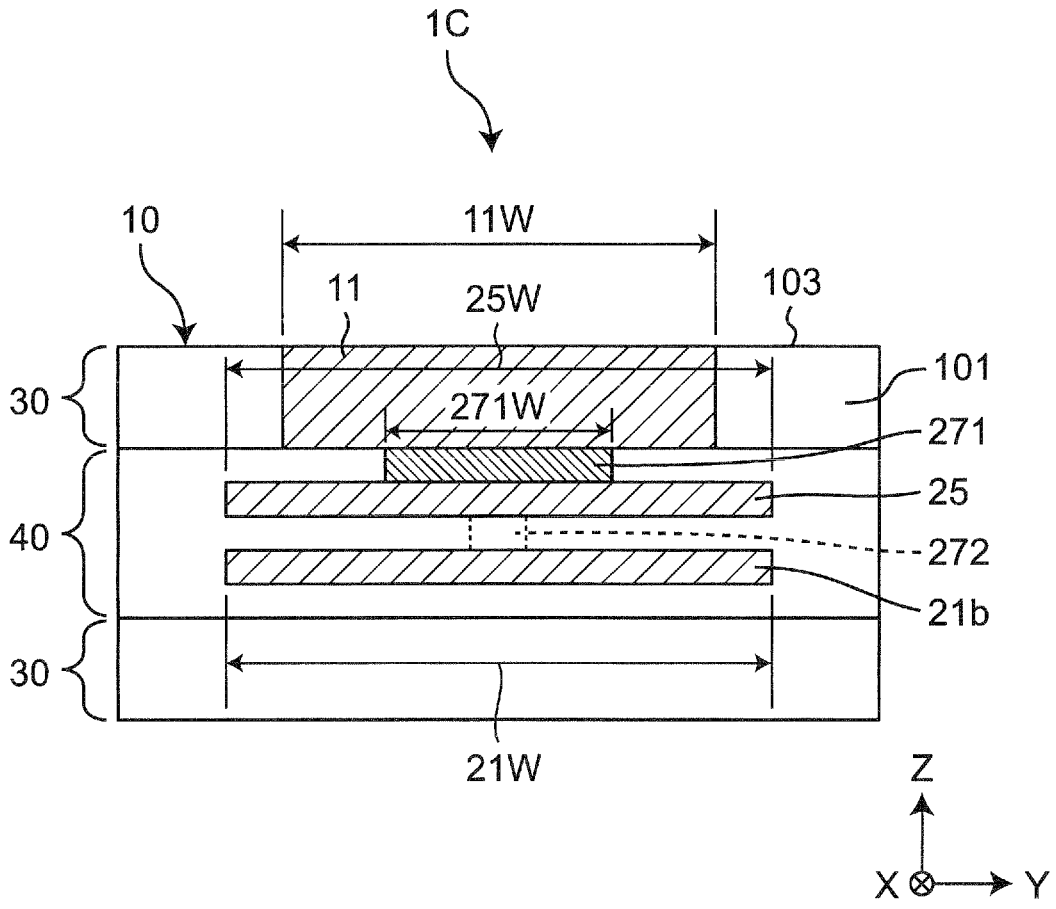
FIG. 7 is a view on the X-direction arrow of a fourth embodiment of the electronic component.

FIG. 7 is a view on the X-direction arrow of a fourth embodiment of the electronic component. In FIG. 7, for clarity, the portions exposed from the element body 10 are indicated by hatching. The fourth embodiment is different from the second embodiment in the configuration of the first via conductor. This different configuration will hereinafter be described. In the fourth embodiment, the same constituent elements as the second embodiment are denoted by the same reference numerals as the second embodiment and therefore will not be described.

As shown in FIG. 7, in a coil component 1C serving as the electronic component, the exposure width 271W of the first via conductor 271 is larger than the width of the second via conductor 272 in the Y direction. When S is an area of contact of the first via conductor 271 with the first lead-out electrode 25 and W is the exposure width 11W of the first columnar electrode 11, S/W satisfies 12.7 μm or more. Although FIG. 7 shows the configuration on the first end surface 101 side of the element body 10, the second end surface 102 side of the element body 10 may have the same configuration.

Therefore, since S/W satisfies 12.7 μm or more, the first columnar electrode 11 can be prevented from peeling from the element body 10 due to peeling occurring between the first via conductor 271 and the first lead-out electrode 25 at a dicing step as described later. When S is larger, the first columnar electrode 11 is improved in the adhesion force to the first lead-out electrode 25 through the first via conductor 271. When W is smaller, the friction applied to the first columnar electrode 11 is reduced during dicing.

As described above, the larger the S/W becomes, the more the peeling of the first columnar electrode 11 from the element body 10 can be reduced. As described later, it was confirmed that peeling of the first columnar electrode 11 did not occur at S/W of 12.7 μm or more and 36.2 μm or less.

Fifth Embodiment

Figure 8:
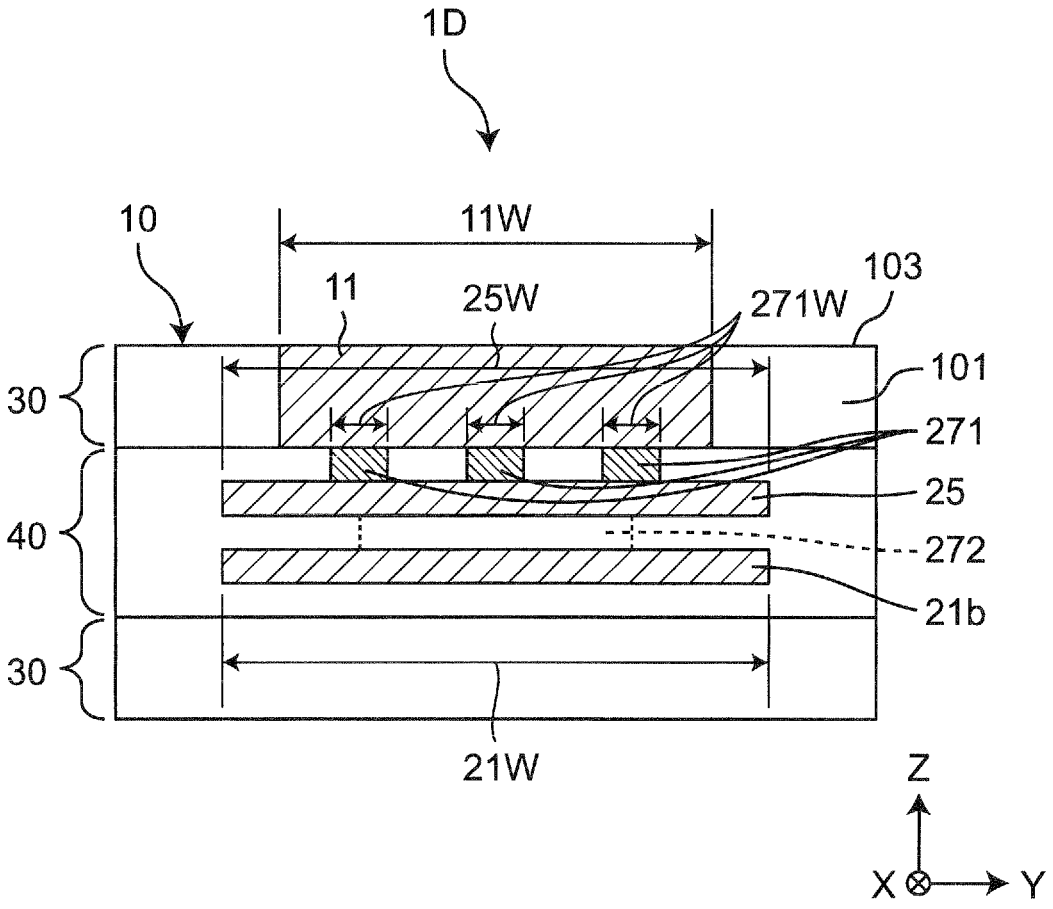
FIG. 8 is a view on the X-direction arrow of a fifth embodiment of the electronic component.
Figure 9:
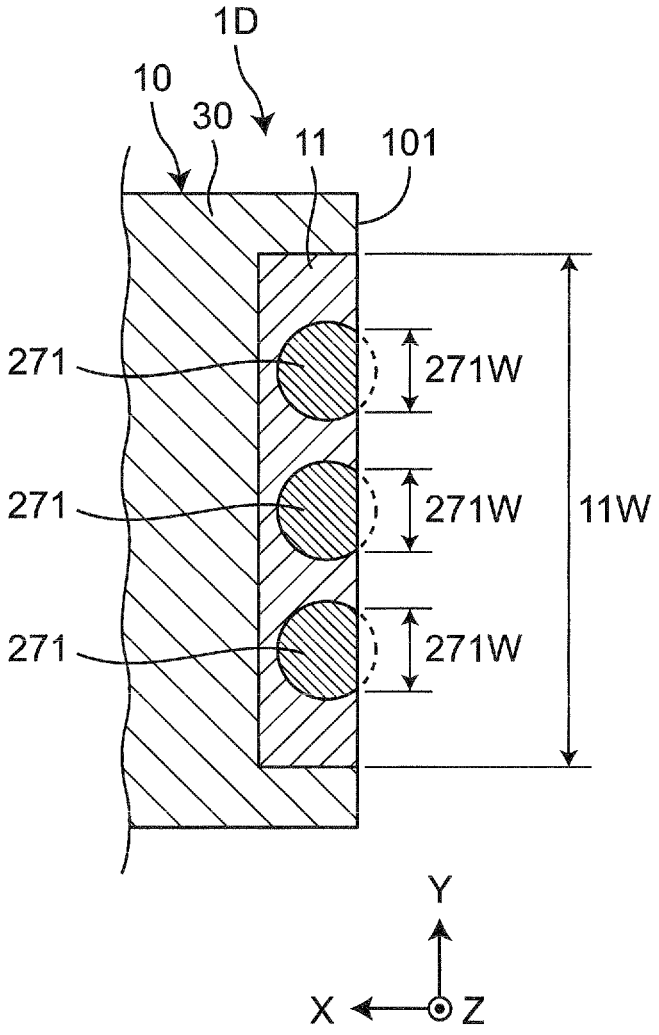
FIG. 9 is an XY cross-sectional view of the fifth embodiment of the electronic component.

FIG. 8 is a view on the X-direction arrow of a fifth embodiment of the electronic component. In FIG. 8, for clarity, the portions exposed from the element body 10 are indicated by hatching. FIG. 9 is an XY cross-sectional view of the fifth embodiment of the electronic component. The fifth embodiment is different from the fourth embodiment in the configuration of the first via conductor and the second via conductor. This different configuration will hereinafter be described. In the fifth embodiment, the same constituent elements as the fourth embodiment are denoted by the same reference numerals as the fourth embodiment and therefore will not be described.

As shown in FIGS. 8 and 9, a coil component 1D serving as the electronic component has a plurality of (in this embodiment, three) first via conductors 271. The sum of the exposure widths 271W of the plurality of the first via conductors 271 is smaller than the exposure width 11W of the first columnar electrode 11. The width of the second via conductor 272 in the Y direction is substantially the same as the sum of the exposure widths 271W of the first via conductors 271. Even if a plurality of the first via conductors 271 exists in this way, the load of cutting of the coil component 1D can be reduced when the sum of the exposure widths 271W is smaller than the exposure width 11W of the first columnar electrode 11. Additionally, by dispersing the plurality of the first via conductors 271, the volumes of the first via conductors 271 arranged in series can be made smaller to reduce a local cutting load during dicing.

The exposure widths 271W of the plurality of the first via conductors 271 are the same as each other. The plurality of the first via conductors 271 is arranged at equal intervals in the second direction (Y direction). Therefore, the adhesion force between the first columnar electrode 11 and the first lead-out electrode 25 can be prevented from locally decreasing during dicing, so as to suppress local peeling of the first columnar electrode 11 during dicing.

When S is the sum of the areas of contact of the plurality of first via conductors 271 with the first lead-out electrodes 25 and W is the exposure width 11W of the first columnar electrode 11, S/W satisfies 12.7 μm or more. Therefore, the first columnar electrode 11 can be prevented from peeling from the element body 10 due to peeling occurring between the first via conductor 271 and the first lead-out electrode 25 at the dicing step.

Figure 10:
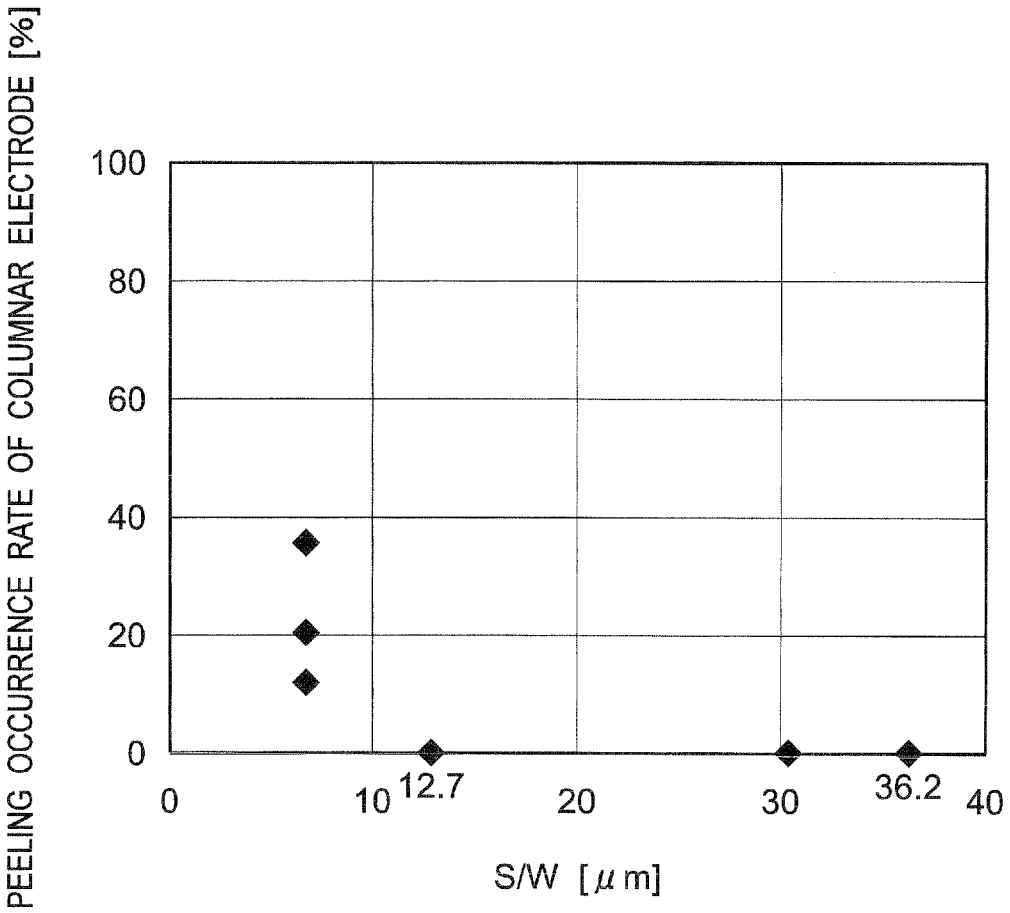
FIG. 10 is a graph of a relationship between S/W and a peeling occurrence rate of a columnar electrode.

FIG. 10 shows a relationship between S/W [μm] and a peeling occurrence rate [%] of a columnar electrode in the coil component 1D shown in FIG. 9. In FIG. 10, the peeling occurrence rate of a plurality of columnar electrodes corresponds to the same S/W, this is because the multiple coil components 1D different in external size were each evaluated. It is noted that as shown in FIG. 10, when S/W is 12.7 μm or more and 36.2μ or less, the peeling occurrence rate of the first columnar electrode 11 is 0%. Although FIG. 10 shows the relationship when a plurality of the first via conductors 271 is arranged at equal intervals as shown in FIG. 9, S compared with W is the sum of the exposure widths, and the relationship is not applied only to the case of the plurality of the first via conductors 271 arranged at equal intervals. Therefore, even when only the one first via conductor 271 exists as in the first to fourth embodiments or a plurality of the first via conductors 271 is present and arranged at various intervals, the peeling of the columnar electrode from the element body 10 can be suppressed as long as S/W is 12.7 μm or more.

Although FIG. 8 shows the configuration on the first end surface 101 side of the element body 10, the second end surface 102 side of the element body 10 may have the same configuration.

Sixth Embodiment

Figure 11:
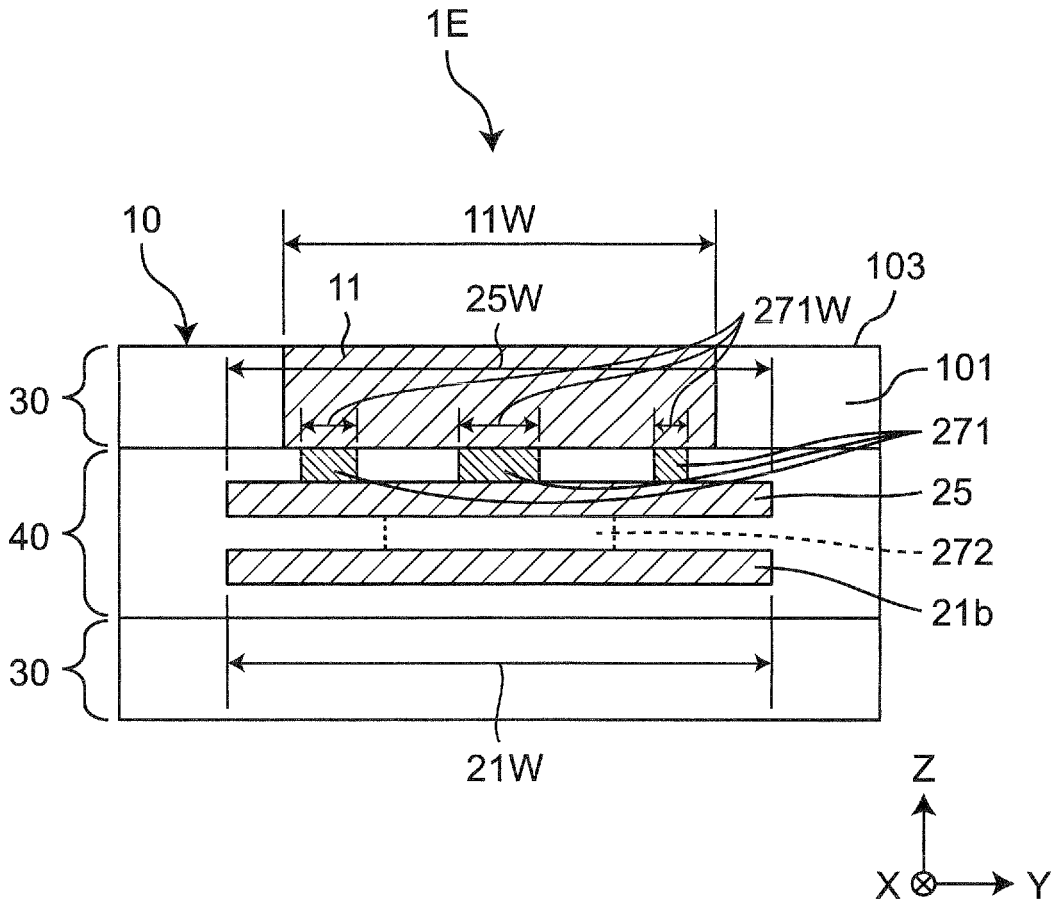
FIG. 11 is a view on the X-direction arrow of a sixth embodiment of the electronic component.

FIG. 11 is a view on the X-direction arrow of a sixth embodiment of the electronic component. In FIG. 11, for clarity, the portions exposed from the element body 10 are indicated by hatching. The sixth embodiment is different from the fifth embodiment in the configuration of the first via conductor. This different configuration will hereinafter be described. In the sixth embodiment, the same constituent elements as the fifth embodiment are denoted by the same reference numerals as the fifth embodiment and therefore will not be described.

As shown in FIG. 11, in a coil component 1E serving as the electronic component, the plurality of the first via conductors 271 has the exposure widths 271W different from each other. In the plurality of the first via conductors 271, the exposure width 271W of at least one of the first via conductors 271 may be different from the exposure width 271W of the other first via conductors 271. The sum of the exposure widths 271W of the plurality of the first via conductors 271 may be the same as the sum of the fifth embodiment.

Although FIG. 11 shows the configuration on the first end surface 101 side of the element body 10, the second end surface 102 side of the element body 10 may have the same configuration.

Seventh Embodiment

Figure 12:
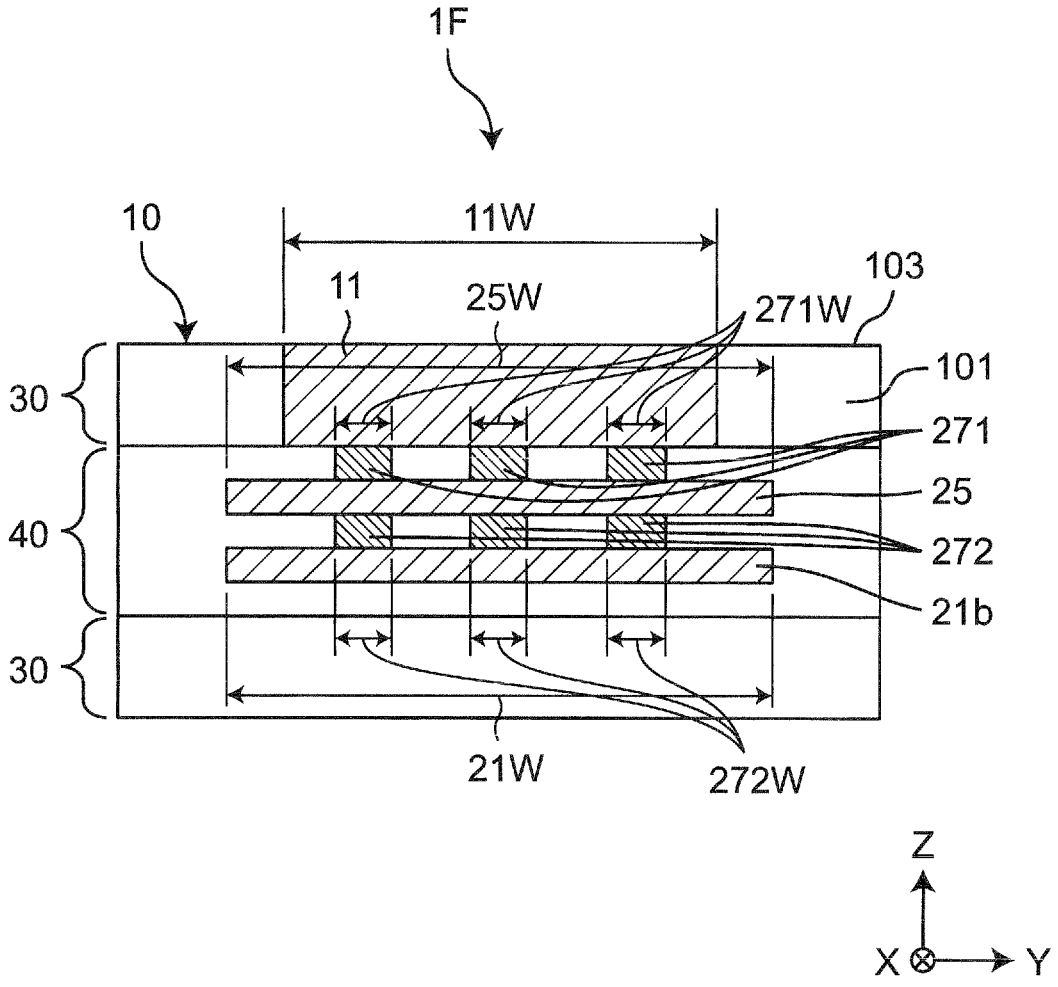
FIG. 12 is a view on the X-direction arrow of a seventh embodiment of the electronic component.

FIG. 12 is a view on the X-direction arrow of a seventh embodiment of the electronic component. In FIG. 12, for clarity, the portions exposed from the element body 10 are indicated by hatching. The seventh embodiment is different from the fifth embodiment in the configuration of the second via conductor. This different configuration will hereinafter be described. In the seventh embodiment, the same constituent elements as the fifth embodiment are denoted by the same reference numerals as the fifth embodiment and therefore will not be described.

As shown in FIG. 12, a coil component 1F serving as the electronic component has a plurality of (in this embodiment, three) second via conductors 272. The sum of the exposure widths 272W of the plurality of the second via conductors 272 is smaller than the exposure width 11W of the first columnar electrode 11. The sum of the exposure widths 272W of the plurality of the second via conductors 272 is the same as, or may be different from, the sum of the exposure widths 271W of the plurality of the first via conductors 271. Even if a plurality of the second via conductors 272 exists in this way, the load of cutting of the coil component can be reduced when the sum of the exposure widths is smaller than the exposure width of the first columnar electrode 11. Additionally, by dispersing the plurality of the second via conductors 272, the volumes of the second via conductors 272 arranged in series can be made smaller to reduce a local cutting load during dicing.

The exposure widths 272W of the plurality of the second via conductors 272 are the same as each other. The plurality of the second via conductors 272 is arranged at equal intervals in the second direction (Y direction) when viewed in a direction orthogonal to the first end surface 101 of the element body 10. Therefore, a local cutting load during dicing can be reduced. Additionally, the adhesion force between the first lead-out electrode 25 and the lead-out electrode 21*b* of the first spiral wiring 21 can be restrained from locally decreasing.

The first via conductors 271 and the second via conductors 272 overlap in the first direction (Z direction) when viewed in the direction orthogonal to the first end surface 101 of the element body 10. Although FIG. 12 shows the configuration on the first end surface 101 side of the element body 10, the second end surface 102 side of the element body 10 may have the same configuration.

Eighth Embodiment

Figure 13:
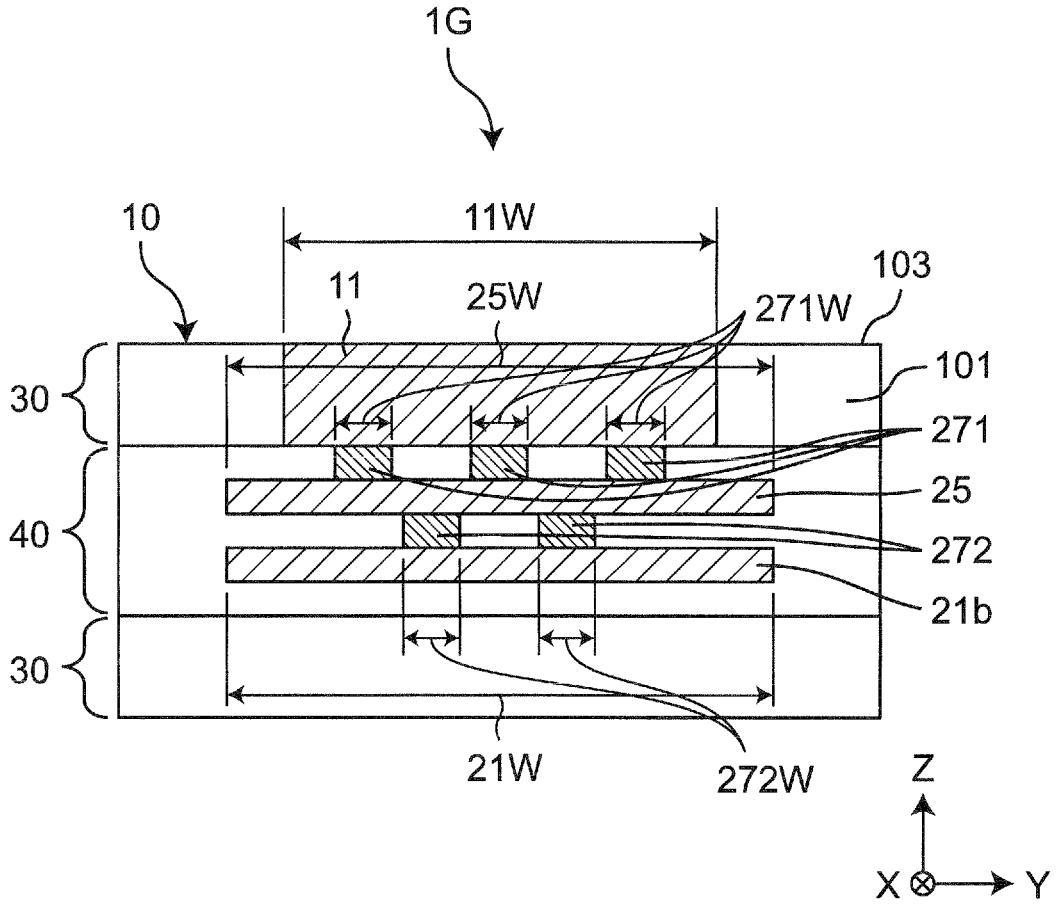
FIG. 13 is a view on the X-direction arrow of an eighth embodiment of the electronic component.

FIG. 13 is a view on the X-direction arrow of an eighth embodiment of the electronic component. In FIG. 13, for clarity, the portions exposed from the element body 10 are indicated by hatching. The eighth embodiment is different from the seventh embodiment in the configuration of the first via conductor and the second via conductor. This different configuration will hereinafter be described. In the eighth embodiment, the same constituent elements as the seventh embodiment are denoted by the same reference numerals as the seventh embodiment and therefore will not be described.

As shown in FIG. 13, in a coil component 1G serving as the electronic component, the first via conductors 271 and the second via conductors 272 are not arranged in line along the first direction (+Z direction). Therefore, the volumes of the first via conductor 271 and the second via conductor 272 arranged in series in the first direction are reduced, so that a local cutting load during dicing can be reduced.

Although FIG. 13 shows the configuration on the first end surface 101 side of the element body 10, the second end surface 102 side of the element body 10 may have the same configuration.

The present disclosure is not limited to the embodiments described above and may be changed in design without departing from the spirit of the present disclosure. For example, respective feature points of the first to eighth embodiments may variously be combined. In this combination, only a portion of the respective feature points of the first to eighth embodiments may be combined.

Although the configuration on the first end surface side of the element body has been described in the embodiments, the second end surface side of the element body may have the same or different configuration. Although exposed from the end surfaces of the element body in the embodiments, the first lead-out electrode and the second lead-out electrode may not be exposed from the end surfaces of the element body. Although two layers of the spiral wirings are included in the embodiments, three or more layers of the spiral wirings may be included. Although the electronic component is a coil component in the embodiments, the electronic component may be a capacitor etc. Therefore, the circuit element embedded in the element body is not limited to the inductor and may be a capacitor, a resistor, etc., or a plurality of these elements may be included in the element body.

What is claimed is:

1. An electronic component comprising:

an element body including a first end surface and a second end surface opposite to each other, and an upper surface connecting the first end surface and the second end surface;

a circuit element embedded in the element body;

a first lead-out electrode embedded on the first end surface side of the element body and electrically connected to the circuit element;

a columnar electrode arranged separately from the first lead-out electrode in a first direction when viewed in a direction orthogonal to the first end surface, and embedded in the element body with a portion exposed from the first end surface to the upper surface; and a first via conductor connecting the first lead-out electrode and the columnar electrode, wherein with regard to an exposure width on the first end surface along a second direction orthogonal to the first direction when viewed in the direction orthogonal to the first end surface, the exposure width of the first via conductor is smaller than the exposure width of the columnar electrode.

2. The electronic component according to claim 1, wherein when S is an area of contact of the first via conductor with the first lead-out electrode and W is the exposure width of the columnar electrode, S/W satisfies 12.7 μm or more.

3. The electronic component according to claim 1, wherein:

the first via conductor is one of a plurality of first via conductors; and a sum of the exposure widths of the plurality of first via conductors is smaller than the exposure width of the columnar electrode.

4. The electronic component according to claim 3, wherein:

the exposure widths of the plurality of first via conductors are the same as each other; and the plurality of first via conductors are arranged at equal intervals in the second direction.

5. The electronic component according to claim 1, further comprising:

a second lead-out electrode embedded on the first end surface side in the element body and disposed separately from the first lead-out electrode toward the side opposite to the first direction; and a second via conductor connecting the first lead-out electrode and the second lead-out electrode, wherein the exposure width of the second via conductor is smaller than the exposure width of the columnar electrode.

6. The electronic component according to claim 5, wherein:

the second via conductor is one of a plurality of second via conductors; and a sum of the exposure widths of the plurality of second via conductors is smaller than the exposure width of the columnar electrode.

7. The electronic component according to claim 6, wherein:

the exposure widths of the plurality of second via conductors are the same as each other; and the plurality of second via conductors are arranged at equal intervals in the second direction.

8. The electronic component according to claim 5, wherein the first via conductor and the second via conductor are not arranged in line along the first direction.

9. The electronic component according to claim 5, wherein a portion of the first via conductor and a portion of the first lead-out electrode are exposed from the first end surface.

10. The electronic component according to claim 9, wherein a portion of the second via conductor and a portion of the second lead-out electrode are exposed from the first end surface.

11. The electronic component according to claim 5, wherein the exposure widths of the first via conductor and the second via conductor are zero.

12. The electronic component according to claim 1, wherein:

the circuit element is an inductor;

the element body is made of a magnetic material and an insulator;

the columnar electrode is in the magnetic material; and the first lead-out electrode, the first via conductor, and the inductor are in the insulator.

13. The electronic component according to claim 12, further comprising:

a first lead-out electrode embedded on the second end surface side of the element body and electrically connected to the circuit element;

a columnar electrode arranged separately from the first lead-out electrode on the second end surface side in the first direction, and embedded in the element body with a portion exposed from the second end surface to the upper surface; and a first via conductor connecting the first lead-out electrode and the columnar electrode on the second end surface side, wherein with regard to a second exposure width on the second end surface along the second direction, the second exposure width of the first via conductor on the second end surface side is smaller than the second exposure width of the columnar electrode on the second end surface side.

14. The electronic component according to claim 13, wherein:

a first end of the inductor is electrically connected to the first lead-out electrode on the first end surface side; and a second end of the inductor is electrically connected to the first lead-out electrode on the second end surface side.

15. The electronic component according to claim 5, wherein:

the circuit element is a laminated inductor made up of a plurality of spiral wirings formed into a spiral shape in a plane parallel to the upper surface;

the element body is made of a magnetic material and an insulator;

the columnar electrode is in the magnetic material; and the first lead-out electrode, the first via conductor, the second lead-out electrode, the second via conductor, and the inductor are in the insulator.

16. The electronic component according to claim 15, further comprising:

a first lead-out electrode embedded on the second end surface side of the element body and electrically connected to the circuit element;

a second lead-out electrode embedded on the second end surface side in the element body and disposed separately from the first lead-out electrode on the second end surface side toward the side opposite to the first direction;

a columnar electrode arranged separately from the first lead-out electrode on the second end surface side in the first direction, and embedded in the element body with a portion exposed from the second end surface to the upper surface;

a first via conductor connecting the first lead-out electrode and the columnar electrode on the second end surface side; and a second via conductor connecting the first lead-out electrode and the second lead-out electrode on the second end surface side, wherein with regard to a second exposure width on the second end surface along the second direction, the second exposure width of the first via conductor on the second end surface side and the second exposure width of the second via conductor on the second end surface side are smaller than the second exposure width of the columnar electrode on the second end surface side.

17. The electronic component according to claim 16, wherein:

a first end of the inductor is electrically connected to the first lead-out electrode or the second lead-out electrode on the first end surface side; and a second end of the inductor is electrically connected to the first lead-out electrode or the second lead-out electrode on the second end surface side.

18. The electronic component according to claim 2, wherein:

the circuit element is an inductor;

the element body is made of a magnetic material and an insulator;

the columnar electrode is in the magnetic material; and the first lead-out electrode, the first via conductor, and the inductor are in the insulator.

19. The electronic component according to claim 3, wherein:

the circuit element is an inductor;

the element body is made of a magnetic material and an insulator;

the columnar electrode is in the magnetic material; and the first lead-out electrode, the first via conductor, and the inductor are in the insulator.

* * * * *